US011449085B2

(12) United States Patent
Yasusaka et al.

(10) Patent No.: US 11,449,085 B2
(45) Date of Patent: Sep. 20, 2022

(54) LINEAR POWER SUPPLY

(71) Applicant: Rohm Co., Ltd., Kyoto (JP)

(72) Inventors: Makoto Yasusaka, Kyoto (JP); Kotaro Iwata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 17/296,401

(22) PCT Filed: Nov. 22, 2019

(86) PCT No.: PCT/JP2019/045817
§ 371 (c)(1),
(2) Date: May 24, 2021

(87) PCT Pub. No.: WO2020/116208
PCT Pub. Date: Jun. 11, 2020

(65) Prior Publication Data

US 2022/0011796 A1 Jan. 13, 2022

(30) Foreign Application Priority Data

Dec. 5, 2018 (JP) ..... JP2018-228336
Mar. 25, 2019 (JP) ..... JP2019-057059

(51) Int. Cl.
*G05F 1/46* (2006.01)
*G05F 3/26* (2006.01)
*G05F 1/56* (2006.01)

(52) U.S. Cl.
CPC ..... *G05F 1/461* (2013.01); *G05F 1/468* (2013.01); *G05F 3/267* (2013.01); *G05F 1/56* (2013.01)

(58) Field of Classification Search
CPC . G05F 1/461; G05F 1/468; G05F 1/56; G05F 3/267
See application file for complete search history.

(56) References Cited

U.S. PATENT DOCUMENTS

2011/0248688 A1* 10/2011 Iacob ..... G05F 1/575 323/234
2012/0013317 A1 1/2012 Morino
(Continued)

FOREIGN PATENT DOCUMENTS

JP 2004-062625 2/2004
JP 2012-022450 2/2012
(Continued)

OTHER PUBLICATIONS

PCT International Search Report in International Appln. No. PCT/JP2019/045817, dated Dec. 17, 2019. 2 pages (with English Translation).

*Primary Examiner* — Kyle J Moody
*Assistant Examiner* — Lakaisha Jackson
(74) *Attorney, Agent, or Firm* — Fish & Richardson P.C.

(57) ABSTRACT

A linear power source 1 comprises: an output transistor 10 that is connected between an input end of an input voltage VIN and an output end of an output voltage VOUT; a driver 30 for driving the output transistor 10 so that a feedback voltage VFB according to the output voltage VOUT matches a reference voltage VREF; a current detection unit 50 for detecting an output current IOUT flowing to the output transistor 10; and a voltage adjustment unit 40 for adjusting the reference voltage VREF or the feedback voltage VFB so that a differential voltage between a first voltage (for example, VIN itself) according to the input voltage VIN and a second voltage (for example, VOUT itself) according to the output voltage VOUT or the reference voltage VREF will not fall below an offset voltage Voffset according to the output current IOUT.

20 Claims, 29 Drawing Sheets

(56) References Cited

U.S. PATENT DOCUMENTS

| | | | | |
|---|---|---|---|---|
| 2016/0299518 | A1 | 10/2016 | Iwata et al. | |
| 2018/0307259 | A1* | 10/2018 | Ogura | G05F 1/575 |
| 2019/0050011 | A1* | 2/2019 | Fujimoto | G05F 1/573 |
| 2019/0079552 | A1* | 3/2019 | Yasusaka | H03K 5/2472 |
| 2019/0360448 | A1* | 11/2019 | Kita | H03K 17/567 |

FOREIGN PATENT DOCUMENTS

| | | |
|---|---|---|
| JP | 2016-200989 | 12/2016 |
| JP | 2018-112963 | 7/2018 |

* cited by examiner

LINEAR POWER SUPPLY

TECHNICAL FIELD

The invention disclosed herein relates to linear power supplies.

BACKGROUND ART

Today, linear power supplies (series regulators such as LDO [low drop-out] regulators) are used as a means for power supply in a variety of devices.

CITATION LIST

Patent Literature

Patent Document 1: Unexamined Japanese patent application publication No. 2018-112963

Patent Document 2: Unexamined Japanese patent application publication No. 2016-200989

SUMMARY OF INVENTION

Technical Problem

A linear power supply that is supplied with a not very stable input voltage (e.g., a battery voltage) has to be configured to provide satisfactory response characteristics (i.e., input transient response characteristics) to cope with transient variations in the input voltage. This is because, with poor input transient response characteristics, a variation in the input voltage results in a variation in the output voltage, possibly leading to poor characteristics, a breakdown, or the like in the load. In particular, nowadays, as linear power supplies are supplied with increasingly low voltages, they are expected to meet increasingly strict requirements in terms of input transient response characteristics.

While the present inventors have hitherto proposed linear power supplies with enhanced input transient response characteristics (Patent Documents 1 and 2 identified below), they still leave room for further improvement when application in a wide load range is taken into account.

In view of the above-mentioned challenge encountered by the present inventors, an object of the invention disclosed herein is to provide a linear power supply that offers enhanced input transient response characteristics over a wide load range.

Solution to Problem

According to one aspect of what is disclosed herein, a linear power supply includes: an output transistor connected between an input terminal for an input voltage and an output terminal for an output voltage; a driver configured to drive the output transistor such that a feedback voltage commensurate with the output voltage remains equal to a reference voltage; a current detector configured to sense an output current passing through the output transistor; and a voltage adjuster configured to adjust the reference voltage or the feedback voltage such that the differential voltage between a first voltage commensurate with the input voltage and a second voltage commensurate with the output voltage or the reference voltage does not fall below an offset voltage commensurate with the output current.

According to another aspect of what is disclosed herein, a linear power supply includes: an output transistor connected between an input terminal for an input voltage and an output terminal for an output voltage; a first amplifier configured to generate a first driving signal by amplifying the difference between the output voltage or a voltage commensurate therewith and a predetermined reference voltage; a second amplifier configured to generate a second driving signal by amplifying the difference between the input voltage or a voltage commensurate therewith and the output voltage or a voltage commensurate therewith; a driver configured to drive the output transistor in accordance with the first and second driving signal; a current detector configured to generate a control signal by sensing an output current passing through the output transistor; and an offset adder configured to feed the second amplifier with an offset voltage commensurate with the control signal.

Other features, elements, steps, benefits, and characteristics of the present invention will become clear through the following detailed description of embodiments and the accompanying drawings associated therewith.

Advantageous Effects of Invention

According to the invention disclosed herein, it is possible to provide a linear power supply that offers enhanced input transient response characteristics over a wide load range.

DESCRIPTION OF EMBODIMENTS

Comparative Example

Figure 1:
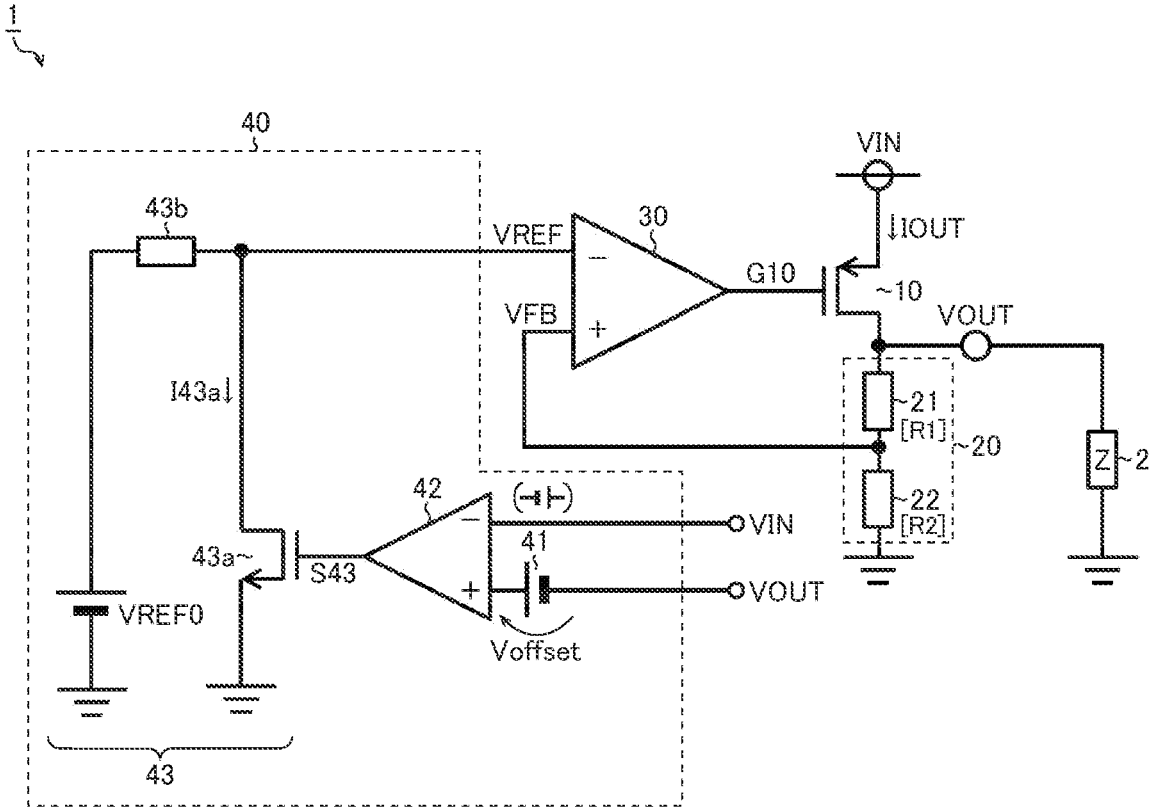
FIG. 1 PRIOR ART
FIG. 1 is a diagram showing a linear power supply of a comparative example.

First, prior to a description of novel embodiments (a first to an eighth embodiment) related to linear power supplies, a comparative example to be compared with them will be described in brief. FIG. 1 is a diagram showing a linear power supply of the comparative example. The linear power supply 1 of this comparative example includes an output transistor 10, a voltage divider 20, a driver 30, and a reference voltage adjuster 40. The linear power supply 1 bucks (steps down) an input voltage VIN to generate a desired output voltage VOUT. The input voltage VIN is supplied from a battery or the like (not shown), and so is not necessarily stable. The output voltage VOUT is supplied to a load 2 (i.e., a secondary power supply, a microcomputer, or the like) in the succeeding stage. The linear power supply 1 can be used as, for example, a reference voltage source incorporated in an IC.

The output transistor 10 is connected between an input terminal for the input voltage VIN and an output terminal for the output voltage VOUT, and the conductivity of the output transistor 10 (reversely put, its on-state resistance value) is controlled in accordance with a gate signal G10 from the driver 30. In the illustrated example, as the output transistor 10, a PMOSFET (P-channel MOSFET) is used. Accordingly, the lower the gate signal G10, the higher the conductivity of the output transistor 10, and thus the higher the output voltage VOUT; the higher the gate signal G10, the lower the conductivity of the output transistor 10, and thus the lower the output voltage VOUT. As the output transistor 10, instead of a PMOSFET, an NMOSFET may be used, or a bipolar transistor may be used.

The voltage divider 20 includes resistors 21 and 22 (with resistance values R1 and R2) that are connected in series between the output terminal for the output voltage VOUT and a grounded terminal, and outputs from the connection node between those resistors a feedback voltage VFB (=VOUT×[R2/(R1+R2)]) commensurate with the output voltage VOUT. Instead, in a case where the output voltage VOUT falls within the input dynamic range of the driver 30, the voltage divider 20 may be omitted, in which case, as the feedback voltage VFB, the output voltage VOUT itself may be fed directly to the driver 30.

The driver 30 drives the output transistor 10 by generating the gate signal G10 such that the feedback voltage VFB, which is fed to the non-inverting input terminal (+) of the driver 30, remains equal to a predetermined reference voltage VREF, which is fed to the inverting input terminal (−) of the driver 30. More specifically, the larger the difference ΔV (=VFB−VREF) between the feedback voltage VFB and the reference voltage VREF, the more the driver 30 raises the gate signal G10; the smaller the difference ΔV, the more the driver 30 lowers the gate signal G10.

The reference voltage adjuster 40 includes an offset adder 41, a differential amplifier 42, and a variable voltage source 43. The reference voltage adjuster 40 has a function of adjusting the reference voltage VREF such that the output transistor 10 does not enter a fully on state, in other words, so as to avoid a state in which the driver 30 has lowered the gate signal G10 to as low a level as it can.

The offset adder 41 offsets the output voltage VOUT to the high-potential side by a predetermined offset voltage Voffset. Preferably the offset voltage Voffset is set at a voltage value lower than the minimum input-output voltage difference VSAT defined for the linear power supply 1 (more detail will be given later).

The differential amplifier 42 generates a control signal S43 for the variable voltage source 43 in accordance with the input voltage VIN, which is fed to the inverting input terminal (−) of the differential amplifier 42, and the offset output voltage (=VOUT+Voffset), which is fed to the non-inverting input terminal (+) of the differential amplifier 42.

The variable voltage source 43 includes an NMOSFET (N-channel MOSFET) 43*a* and a resistor 43*b*, and adjusts the voltage value of the reference voltage VREF in accordance with the control signal S43 output from the differential amplifier 42.

The NMOSFET 43*a* is connected between the inverting input terminal (−) of the driver 30 (i.e., an output terminal for the reference voltage VREF) and the grounded terminal, and the conductivity of the NMOSFET 43*a* is controlled in accordance with the control signal S43 (i.e., gate signal) output from the differential amplifier 42. Accordingly the drain current I43*a* that passes through the NMOSFET 43*a* is higher the higher the control signal S43, and is lower the lower the control signal S43.

The resistor 43*b* (with a resistance value R43*b*) is connected between an application terminal for a reference voltage VREF0 (corresponding to the steady-state value of the reference voltage VREF) and the inverting input terminal (−) of the driver 30. The resistor 43*b* receives the drain current I43*a* that passes through the NMOSFET 43*a* and thus lowers the reference voltage VREF0 by the voltage drop (I43*a*×R43*b*) across the resistor 43*b*, which thereby generates the reference voltage VREF (=VREF0−I43*a*×R43*b*). That is, the reference voltage VREF has the steady-state value (=VREF0) when I43*a*=0A, and lowers from the steady-state value the more the higher the drain current 143*a*.

In the linear power supply 1 of this embodiment, when the differential voltage (VIN−VOUT) between the input voltage VIN and the output voltage VOUT is higher than the offset voltage Voffset, the control signal S43 is held at low level, thereby to keep the NMOSFET 43*a* off and hold the reference voltage VREF at the steady-state value.

On the other hand, when the differential voltage (VIN−VOUT) falls down to the offset voltage Voffset, to prevent a further fall, the control signal S43 is raised, thereby to pass the drain current I43*a* through the NMOSFET 43*a* and lower the reference voltage VREF from the steady-state value.

While the above description deals with a configuration where the output voltage VOUT is offset, a configuration is also possible where, instead, the input voltage VIN is offset. Specifically, as indicated in parentheses in FIG. 1, an offset adder that offsets the input voltage VIN to the low-potential side by an offset voltage Voffset may be provided so that the output voltage VOUT and the offset input voltage (=VIN−Voffset) are differentially fed to the differential amplifier 42.

Input Transient Response Characteristics (with Reference Voltage Fixed)

Prior to a discussion of the significance of introducing the reference voltage adjustment function described above, a brief description will be given of input transient response characteristics observed when the reference voltage VREF has a fixed value.

Figure 2:
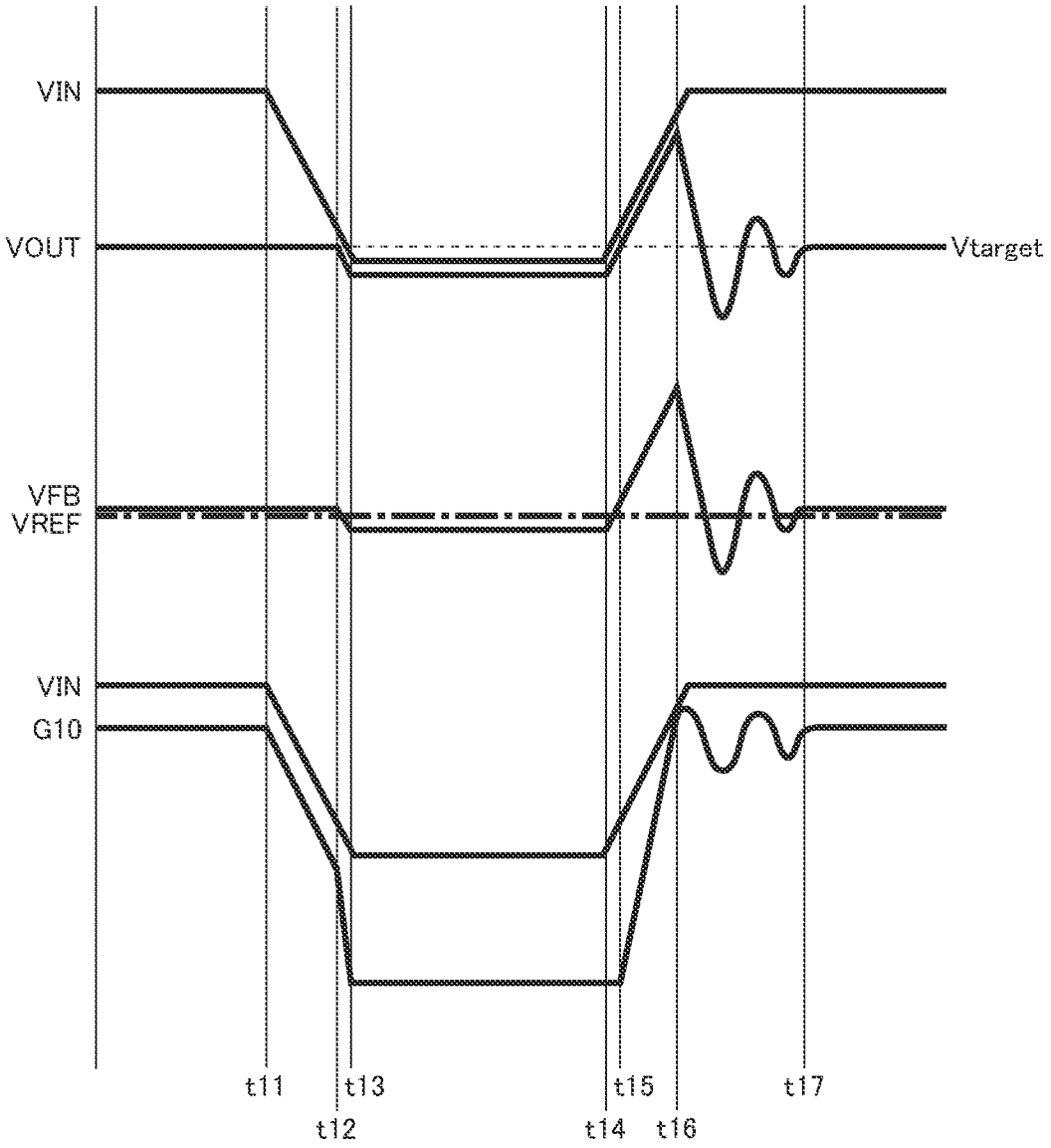
FIG. 2 PRIOR ART
FIG. 2 is a diagram showing input transient response characteristics observed with a reference voltage fixed.

FIG. 2 is a diagram showing input transient response characteristics observed with the reference voltage fixed. FIG. 2 shows, in the upper tier, the relationship between the input voltage VIN and the output voltage VOUT; in the middle tier, the relationship between the reference voltage VREF (dash-and-dot line) and the feedback voltage VFB (solid line); in the lower tier, the relationship between the input voltage VIN and the gate signal G10.

Suppose, for the sake of discussion, the reference voltage VREF has a fixed value. In that case, when the input voltage VIN falls until it becomes lower than a target output value Vtarget (a target value for the output voltage VOUT), the feedback voltage VFB stays constantly lower than the reference voltage VREF. As a result, the driver 30 enters a state in which it has lowered the gate signal G10 to as low a level as it can, and thus the output transistor 10 enters the fully on state (see from time point t12 to time point t15). That is, the driver 30 enters a state in which it operates like a comparator.

When from this state the input voltage VIN rises sharply to a voltage higher than the target output value Vtarget, the driver 30 tends to raise the gate signal G10 to turn off the output transistor 10. However, the gate signal G10, now fallen fully down to low level, is difficult to raise in a way to immediately follow the sharp change in the input voltage VIN. As a result, with the output transistor 10 left in the fully on state, the input voltage VIN is output as it is, causing an overshoot in the output voltage VOUT (see from time point t15 to time point t17). Such an overshoot may lead to the load 2 malfunctioning or breaking down.

The speed at which the output transistor 10 is turned off depends on the response speed of the driver 30, the current capacity in the output stage of the driver 30, the impedances of internal terminals in the driver 30, the gate capacity of the output transistor 10, etc. On the other hand, the convergence time of an overshoot depends on the characteristics (phase margin, response speed) of the driver 30.

Input Transient Response Characteristics (with Reference Voltage Adjusted)

Next, a brief description will be given of input transient response characteristics observed when the reference voltage VREF has a variable value.

Figure 3:
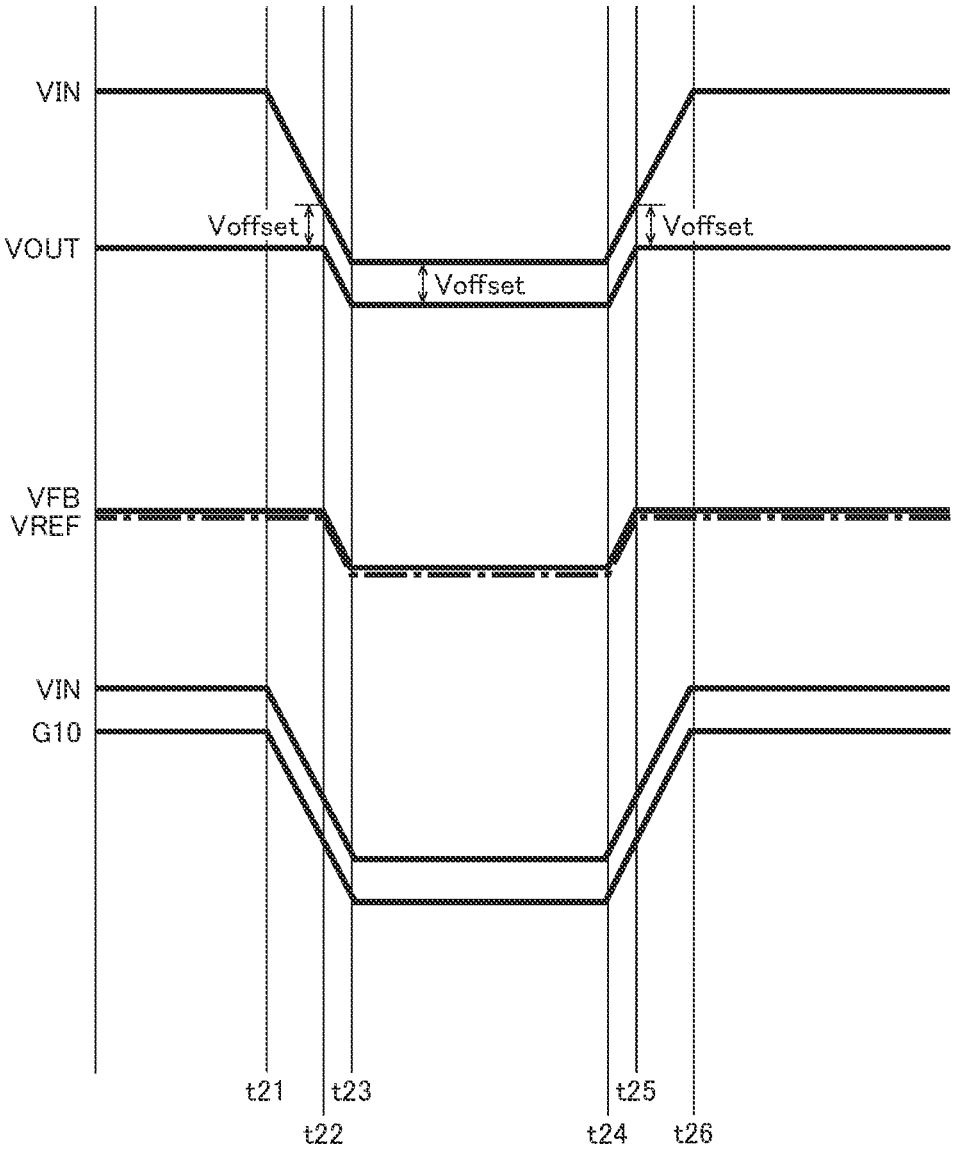
FIG. 3 PRIOR ART
FIG. 3 is a diagram showing input transient response characteristics observed with a reference voltage adjusted (in a light-load region)

FIG. 3 is a diagram showing input transient response characteristics observed with the reference voltage adjusted. Like FIG. 2 referred to previously, FIG. 3 shows, in the upper tier, the relationship between the input voltage VIN and the output voltage VOUT; in the middle tier, the relationship between the reference voltage VREF (dash-and-dot line) and the feedback voltage VFB (solid line); in the lower tier, the relationship between the input voltage VIN and the gate signal G10.

In the linear power supply 1 of this comparative example, the reference voltage adjuster 40 monitors both the input voltage VIN and the output voltage VOUT. When the differential voltage (VIN−VOUT) between the two voltages is higher than the offset voltage Voffset, the reference voltage adjuster 40 holds the reference voltage VREF at the steady-state value (see before time point t22, or after time point t25); when the differential voltage (VIN−VOUT) falls down to the offset voltage Voffset, to prevent a further fall, the reference voltage adjuster 40 lowers the reference voltage VREF from the steady-state value (see from time point t22 to time point t25).

Through the reference voltage adjustment operation described above, even if the input voltage VIN falls, the target value of the output voltage VOUT can be kept constantly lower than the input voltage VIN. This prevents the output transistor 10 from entering the fully on state, and thus the driver 30 keeps the gate signal G10 at an adequate voltage value (e.g., VIN−Vth, where Vth is the on-threshold voltage of the output transistor 10).

Once in this way the output transistor 10 is prevented from entering the fully on state in response to a fall in the input voltage VIN, even if thereafter the input voltage VIN rises sharply, the gate signal G10 can be raised in a way to immediately follow the gate signal G10. It is thus possible to minimize an overshoot in output voltage VOUT.

Here, lowering the reference voltage VREF entails the output voltage VOUT falling below the intended target value. A fall in the output voltage VOUT may lead to degraded characteristics in the load 2 that is connected in the succeeding stage, and thus the reference voltage VREF needs to be adjusted within such a range as not to bring an adverse effect.

One possible criterion is the minimum input-output voltage difference VSAT defined for the linear power supply 1. The minimum input-output voltage difference VSAT corresponds to the lowest input-output voltage difference (i.e., the differential voltage (=Vin−VOUT) between the input voltage VIN and the output voltage VOUT) that is needed to stably supply a predetermined output current IOUT from the linear power supply 1 to the load 2; generally the minimum input-output voltage difference VSAT depends on the on-state resistance value RON of the output transistor 10 in the fully on state and the current value of the output current IOUT that passes in that state.

In view of the foregoing, it can safely be said that preferably the offset voltage Voffset (corresponding to the degree of the lowering of the output voltage VOUT in response to a fall in the input voltage VIN) is set at a voltage value lower than the minimum input-output voltage difference VSAT. With such a voltage selected, even if the reference voltage adjustment operation described above causes a fall in the output voltage VOUT, it does not interfere with the stable operation of the linear power supply 1.

Input Transient Response Characteristics (in Heavy-Load Region)

Though no mention has been made with reference to FIGS. 2 and 3, the output transistor 10 even in the fully on state has an on-state resistance value RON, which inevitably produces between its drain and source a drain-source voltage Vds (=IOUT×RON) in accordance with the output current IOUT.

Here, in a load region where the output current IOUT passing through the output transistor 10 is low and IOUT×RON<Voffset (called a light-load region in the following description), the reference voltage adjustment function described previously works, so as to suppress an overshoot in the output voltage VOUT resulting from a sharp change in the input voltage VIN.

On the other hand, in a load region where the output current IOUT passing through the output transistor 10 is high and IOUT×RON>Voffset (called a heavy-load region in the following description), the differential voltage (VIN−VOUT) between the input voltage VIN and the output voltage VOUT does not fall below the offset voltage Voffset. As a result, the control signal S43 is constantly at low level, and thus the NMOSFET 43*a* is kept off, bringing a state where the reference voltage VREF is held at the steady-state value (i.e., a state where the reference voltage adjustment function described previously does not work).

Figure 4:
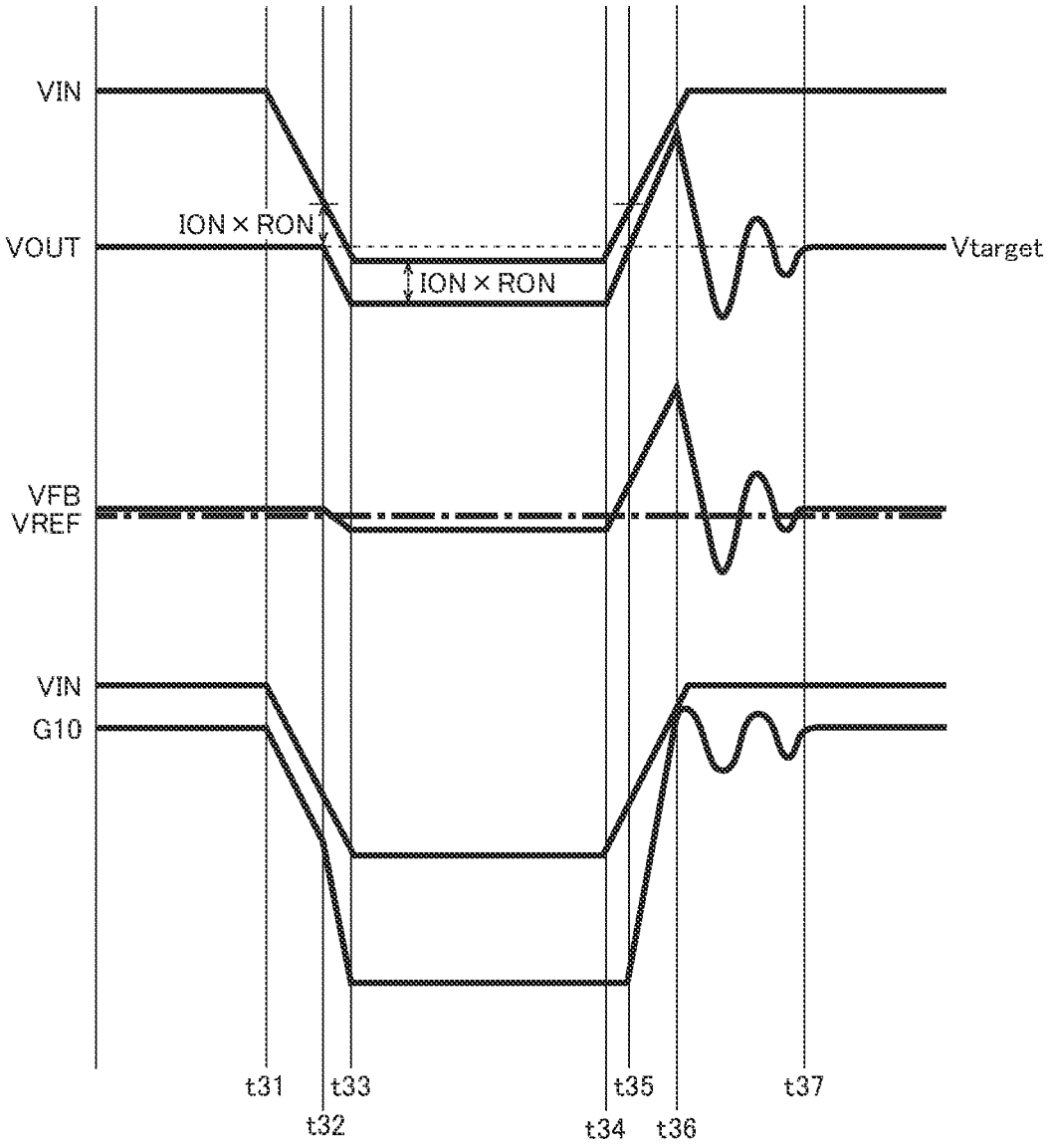
FIG. 4 PRIOR ART
FIG. 4 is a diagram showing input transient response characteristics observed in a heavy-load region.

FIG. 4 is a diagram showing input transient response characteristics observed in a heavy-load region. Like FIGS. 2 and 3 referred to previously, FIG. 4 shows, in the upper tier, the relationship between the input voltage VIN and the output voltage VOUT; in the middle tier, the relationship between the reference voltage VREF (dash-and-dot line) and the feedback voltage VFB (solid line); in the lower tier, the relationship between the input voltage VIN and the gate signal G10.

As mentioned previously, in a heavy-load region, the reference voltage adjustment function does not work, and the reference voltage VREF remains held at the steady-state value. Accordingly, when the input voltage VIN lowers until VIN<Vtarget+ION×RON, the output voltage VOUT can no longer be kept at the target output value Vtarget, and thus the feedback voltage VFB stays constantly below the reference voltage VREF. As a result, the driver 30 enters a state where it has lowered the gate signal G10 to as low a level as it can, and thus the output transistor 10 enters the fully on state (see from time point t32 to time point t35).

When from this state the input voltage VIN rises sharply until VIN>Vtarget+ION×RON, the driver 30 tends to raise the gate signal G10 to turn off the output transistor 10. However, the gate signal G10, now fallen fully down to low level, is difficult to raise in a way to immediately follow the sharp change in the input voltage VIN. As a result, with the output transistor 10 left in the fully on state, the input voltage VIN is output as it is, causing an overshoot in the output voltage VOUT (see from time point t35 to time point t37).

As described above, the input transient response characteristics observed in a heavy-load region (FIG. 4) are no different from those when the reference voltage is fixed (FIG. 2), and thus the introduction of the reference voltage adjustment function has no sense.

Incidentally, the simplest solution to the inconvenience mentioned above is to raise the offset voltage Voffset. However, an offset voltage Voffset raised on a constant basis causes, in response to a fall in the input voltage VIN, a large fall in the output voltage VOUT irrespective of load heaviness, possibly leading to degraded characteristics.

Proposed below will be various embodiments that provide a solution to the inconvenience mentioned above.

First Embodiment

Figure 5:
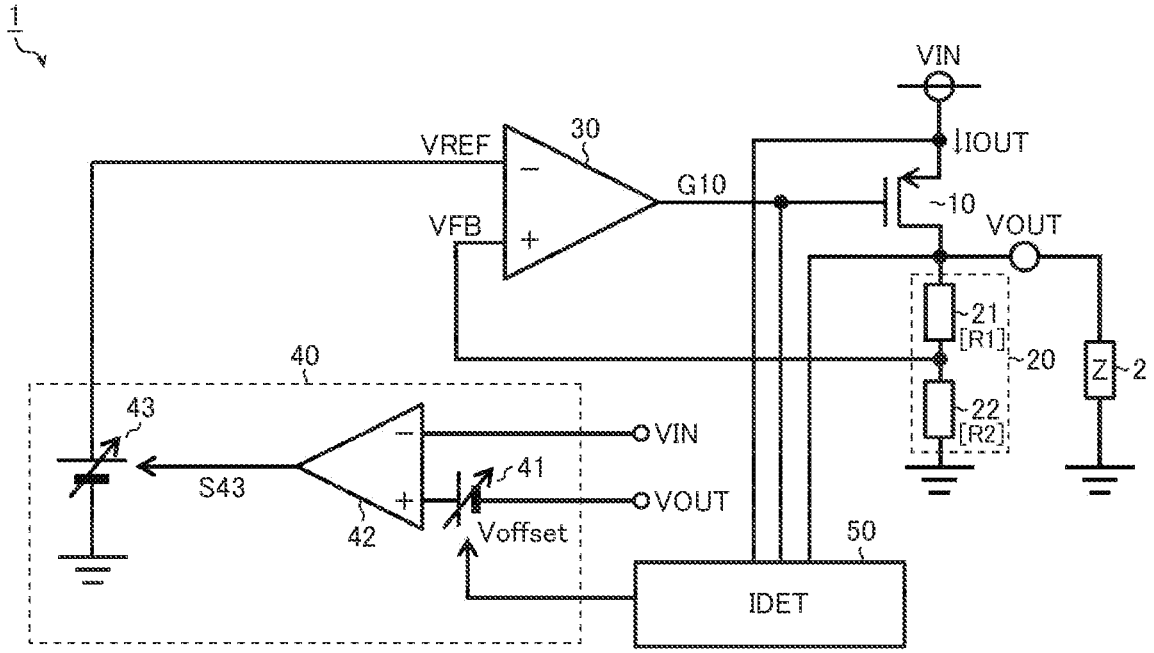
FIG. 5 is a diagram showing a linear power supply according to a first embodiment.

FIG. 5 is a diagram showing a linear power supply according to a first embodiment. The linear power supply 1 of this embodiment is based on the comparative example (FIG. 1) described previously, and further includes a current detector 50. While in FIG. 5 the variable voltage source 43 is represented by a single circuit symbol, it actually has an internal configuration as shown in FIG. 1.

The reference voltage adjuster 40 adjusts the reference voltage VREF such that the differential voltage (=VIN−VOUT) between the input voltage VIN and the output voltage VOUT does not fall below the offset voltage Voffset. More specifically, when the differential voltage (=VIN−VOUT) is higher than the offset voltage Voffset, the 40 holds the reference voltage VREF at the steady-state value; when differential voltage (=VIN−VOUT) falls down to the offset voltage Voffset, to prevent a further fall, the reference voltage adjuster 40 lowers the reference voltage VREF from the steady-state value. This basic operation is no different from that in the comparative example (FIG. 1) described previously.

The current detector 50 senses the output current IOUT that passes through the output transistor 10, and feeds a sense current commensurate with its current value (e.g., a sense current corresponding to 1/m of the output current IOUT, or a mirror current of such a sense current) to the offset adder 41.

The offset adder 41 is a circuit block that shifts the output voltage VOUT to the high-potential side by the offset voltage Voffset, and additionally has a function of variably controlling the offset voltage Voffset in accordance with a control signal from the current detector 50. The offset voltage Voffset is higher the higher the output current IOUT, and is lower the lower the output current IOUT.

Figure 6:
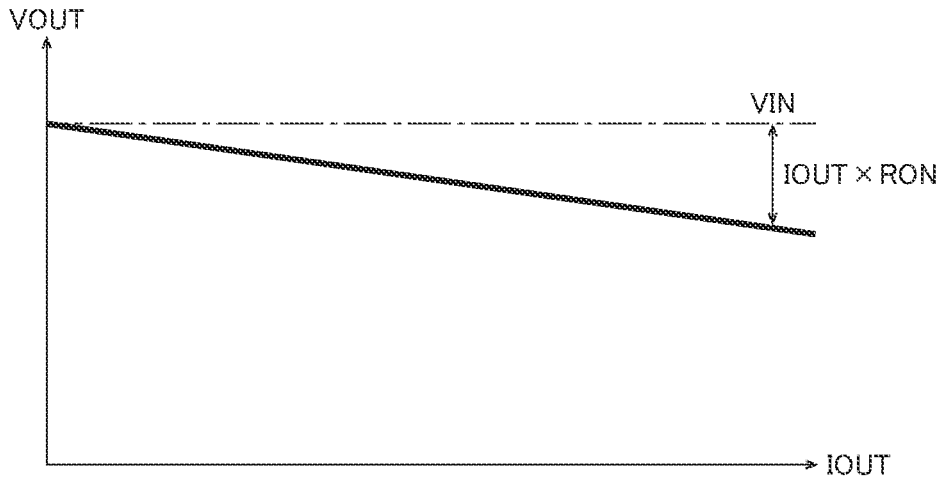
FIG. 6 is a correlation diagram of an output current versus an output voltage (with a reference voltage fixed)
Figure 7:
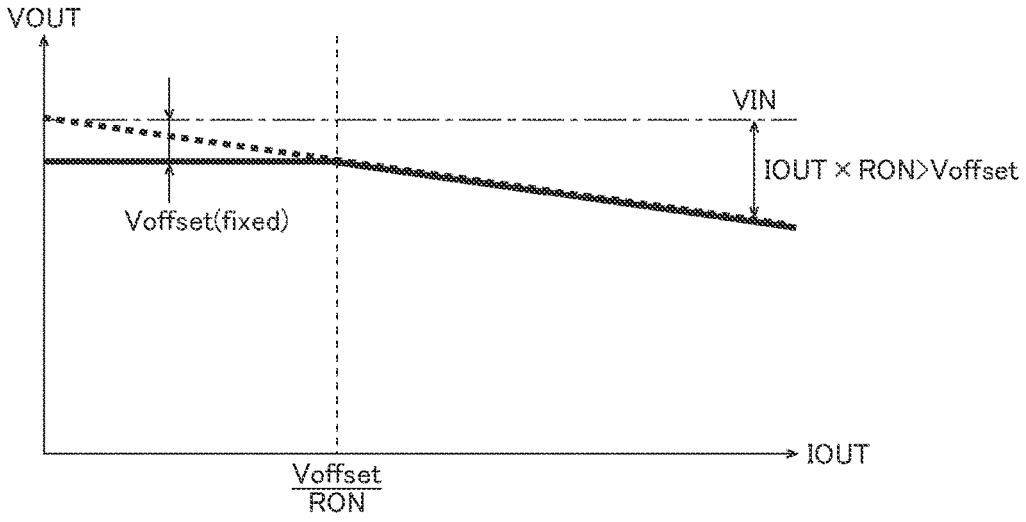
FIG. 7 is a correlation diagram of an output current versus an output voltage (with a reference voltage adjusted, an offset voltage fixed)
Figure 8:
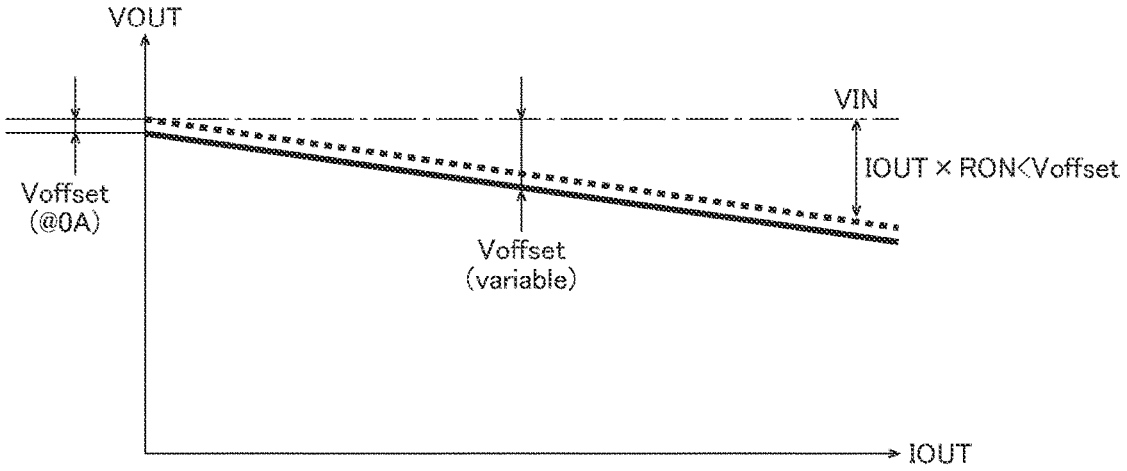
FIG. 8 is a correlation diagram of an output current versus an output voltage (with a reference voltage adjusted, an offset voltage varied)

FIGS. 6 to 8 are each a correlation diagram of the output current IOUT (horizontal axis) versus the output voltage VOUT (vertical axis). FIG. 6 depicts output behavior observed with VREF fixed, and FIG. 7 depicts output behavior observed with VREF adjusted (with Voffset fixed) (i.e., output behavior observed in the comparative example). On the other hand, FIG. 8 depicts output behavior observed with VREF adjusted (with Voffset varied) (i.e., output behavior observed in the first embodiment). For comparison, FIGS. 7 and 8 also show, with broken lines, output behavior with VREF fixed (FIG. 6). These diagrams will be studied comparatively in the following discussion of the advantages of the first embodiment (FIG. 5).

First, the output behavior shown in FIG. 6 (with VREF fixed) will be described. In this case, as the input voltage VIN falls, the output transistor 10 can enter the fully on state without any restriction; thus simply a voltage drop (=IOUT×RON) commensurate with the output current IOUT and the on-state resistance value RON of the output transistor 10 occurs. Accordingly, depending on the characteristics of the driver 30, the output voltage VOUT may suffer an overshoot in any load condition.

Next, the output behavior shown in FIG. 7 (with VREF adjusted (with Voffset fixed)) will be described. In this case, in a light-load region (IOUT<Voffset/RON), even if the input voltage VIN falls, the reference voltage adjustment function described previously works such that the differential voltage (=VIN−VOUT) between the input voltage VIN and the output voltage VOUT does not fall below the offset voltage Voffset. Accordingly, the output transistor 10 does not enter the fully on state, and the output voltage VOUT is prevented from suffering an overshoot.

However, in a heavy-load region (IOUT>Voffset/RON), the reference voltage adjustment function no longer works. Accordingly, as the input voltage VIN falls, the output transistor 10 may enter the fully on state, and thus the output voltage VOUT may suffer an overshoot. Raising the offset voltage Voffset may widen the load range in which the reference voltage adjustment function works, but as mentioned previously, that is done in a trade-off for a larger fall in output under a light load.

Next, the output behavior shown in FIG. 8 (with VREF adjusted (with Voffset varied)) will be described. In this case, the offset voltage Voffset is variably controlled such that over the entire load region the offset voltage Voffset satisfies IOUT×RON<Voffset and in addition that the offset voltage Voffset is higher the higher the output current IOUT and is lower the lower the output current IOUT.

Accordingly, when the input voltage VIN falls, the reference voltage adjustment function described previously works irrespective of the load condition. As a result, it is possible to prevent the output transistor 10 from entering the fully on state over a wide load region, and hence to suppress an overshoot in the output voltage VOUT over a wide load region and thereby enhance the input transient response characteristics of the linear power supply 1.

Moreover, the offset voltage Voffset is set to be minimal in accordance with the output current IOUT; thus in particular under no load (IOUT=0 A) or in a light-load region (IOUT<Voffset/RON) it is possible to prevent an unnecessary fall in the output voltage VOUT.

Figure 9:
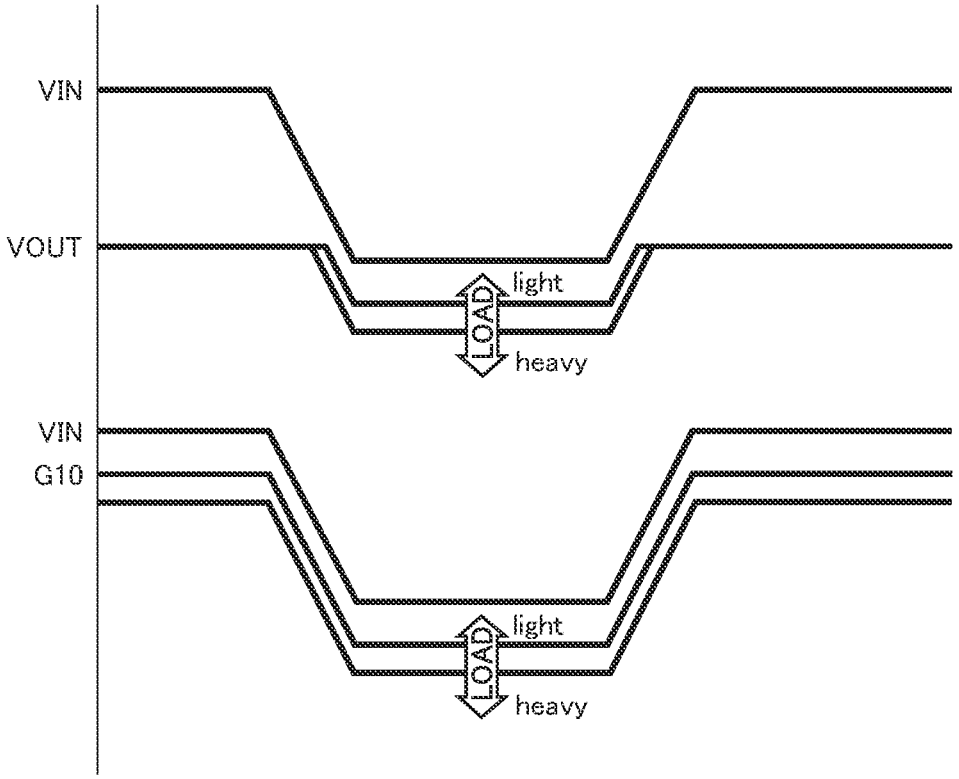
FIG. 9 is a diagram showing input transient response characteristics observed in the first (or ninth) embodiment.

FIG. 9 is a diagram showing input transient response characteristics observed in the first embodiment (with VREF adjusted (with Voffset varied)). FIG. 9 shows, in the upper tier, the relationship between the input voltage VIN and the output voltage VOUT and, in the lower tier, the relationship between the input voltage VIN and the gate signal G10.

With the linear power supply 1 of this embodiment, through the reference voltage adjustment operation described previously, even when the input voltage VIN falls, the target value of the output voltage VOUT can be kept constantly lower than the input voltage VIN. Thus the output transistor 10 does not enter the fully on state, and the gate signal G10 is kept at an adequate voltage value. Certainly, as the load is increasingly heavy, the gate signal G10 falls to pass an increasingly high output current IOUT; even then the gate signal G10 is not lowered to as low a level as the driver 30 can.

Preventing in this way the output transistor 10 from entering the fully on state in response to a fall in the input voltage VIN makes it possible, even if thereafter the input voltage VIN rises sharply, to raise the gate signal G10 in a way to immediately follow the sharp change. It is thus possible to minimize an overshoot in the output voltage VOUT.

Moreover, with the linear power supply 1 of this embodiment, in accordance with the output current IOUT, the offset voltage Voffset is variably controlled. This helps keep the degree of the lowering of the output voltage VOUT (i.e., the offset voltage Voffset) the smaller the lighter the load (the lower the output current IOUT). It is thus possible to keep an adequate output voltage VOUT.

Second Embodiment

Figure 10:
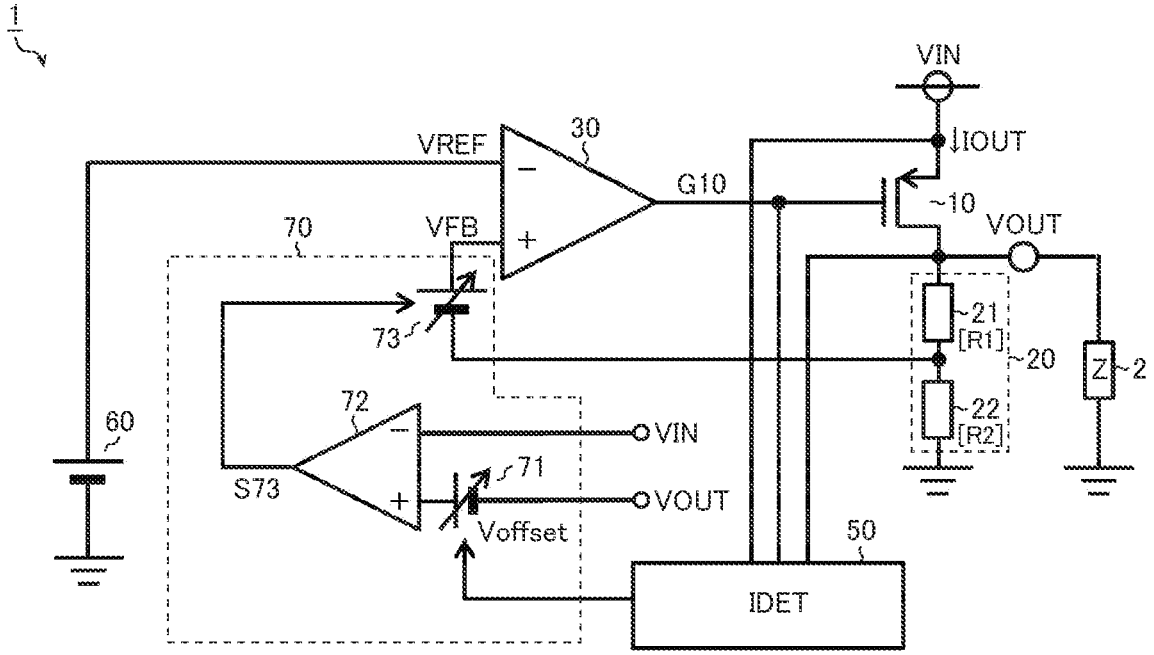
FIG. 10 is a diagram showing a linear power supply according to a second embodiment.

FIG. 10 is a diagram showing a linear power supply according to a second embodiment. The linear power supply 1 of this embodiment is based on the first embodiment (FIG. 5) described previously, and includes, instead of the reference voltage adjuster 40, a constant voltage source 60 and a feedback voltage adjuster 70.

The constant voltage source 60 generates a predetermined reference voltage VREF and feeds it to the inverting input terminal (−) of the driver 30.

The feedback voltage adjuster 70 is a circuit block that adjusts the feedback voltage VFB such that the differential voltage (=VIN−VOUT) between the input voltage VIN and the output voltage VOUT does not fall below the offset voltage Voffset. The feedback voltage adjuster 70 includes an offset adder 71, a differential amplifier 72, and a variable voltage source 73.

The offset adder 71 is a circuit block that shifts the output voltage VOUT to the high-potential side by the offset voltage Voffset, and as in the first embodiment (FIG. 5) described previously has a function of variably controlling the offset voltage Voffset in accordance with a control signal from the current detector 50. Specifically, the offset voltage Voffset is higher the higher the output current IOUT, and is lower the lower the output current IOUT.

The differential amplifier 72 generates a control signal S73 for the variable voltage source 73 in accordance with the input voltage VIN, which is fed to the inverting input terminal (−) of the differential amplifier 72, and the offset output voltage (=VOUT+Voffset), which is fed to the non-inverting input terminal (+) of the differential amplifier 72.

The variable voltage source 73 adjusts the voltage value of the feedback voltage VFB in accordance with the control signal S73 output from the differential amplifier 72. More specifically, while the control signal S73 is kept at low level, the variable voltage source 73 does not shift the feedback voltage VFB but feeds it as it is to the non-inverting input terminal (+) of the driver 30; when the control signal S73 rises from low level, the variable voltage source 73 shifts the feedback voltage VFB to the high-potential side the more the higher the voltage value of the control signal S73.

That is, when the differential voltage (=VIN−VOUT) is higher than the offset voltage Voffset, the feedback voltage adjuster 70 delivers the feedback voltage VFB as it is to the driver 30; when the differential voltage ('VIN−VOUT) falls down to the offset voltage Voffset, to prevent the differential voltage (=VIN−VOUT) from further falling, the feedback voltage adjuster 70 delivers the feedback voltage VFB after raising it to the driver 30.

In this way, preventing the output transistor 10 from entering the fully on state can be achieved by adjusting, instead of the reference voltage VREF, the feedback voltage VFB.

Third Embodiment

Figure 11:
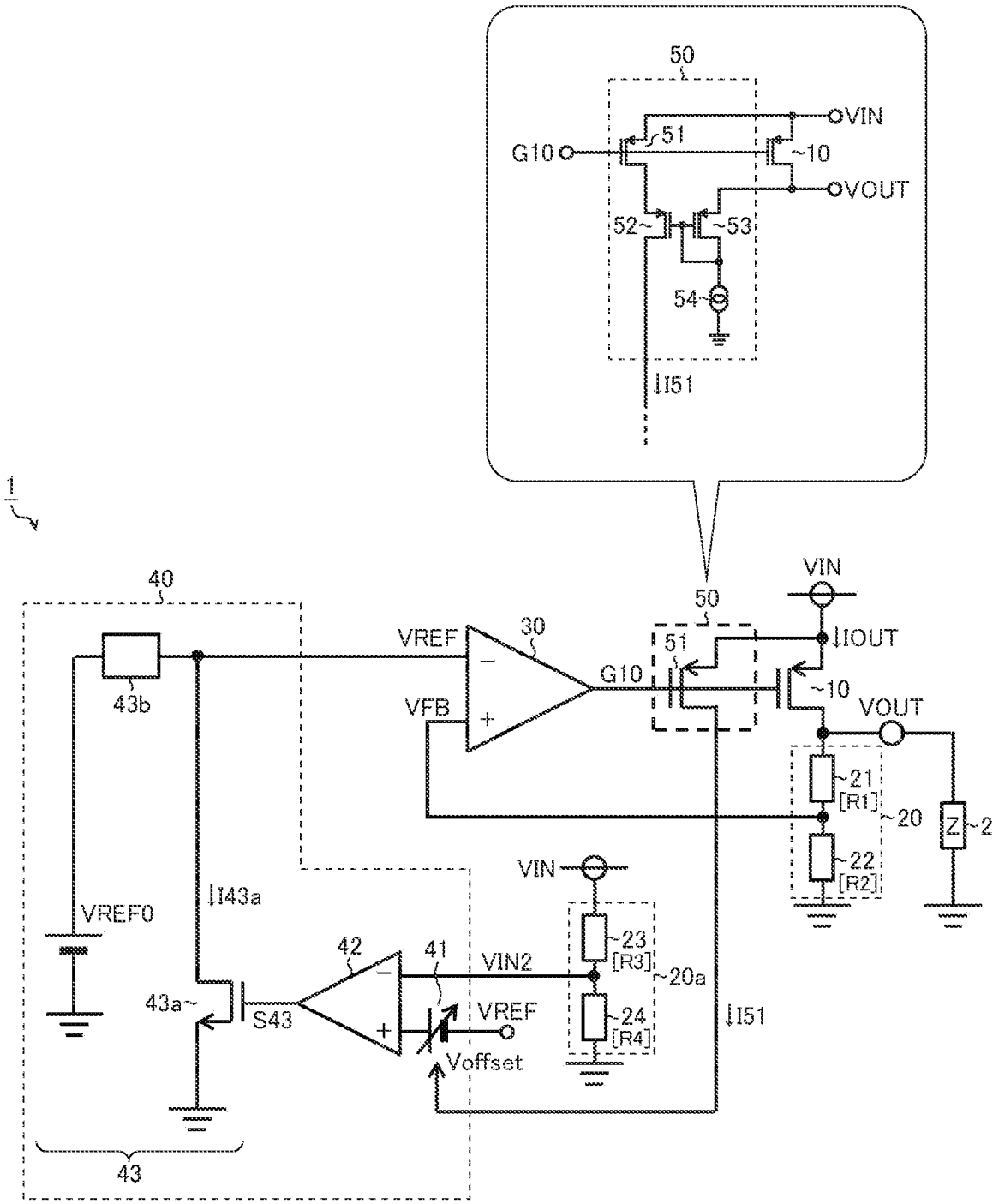
FIG. 11 is a diagram showing a linear power supply according to a third embodiment.

FIG. 11 is a diagram showing a linear power supply according to a third embodiment. The linear power supply 1 of this embodiment is based on the first embodiment (FIG. 5) described previously, and further includes a voltage divider 20*a* that generates from the input voltage VIN a divided input voltage VIN2. For the differential input signals to the reference voltage adjuster 40, instead of the input voltage VIN the divided input voltage VIN2 is used, and instead of the output voltage VOUT the reference voltage VREF is used. FIG. 11 depicts, as the variable voltage source 43, circuit elements (an NMOSFET 43*a* and a resistor 43*b*) similar to those in the comparative example (FIG. 1).

The voltage divider 20*a* includes resistors 23 and 24 (with resistance values R3 and R4) connected in series between the application terminal for the input voltage VIN and the grounded terminal, and outputs from the connection node between those resistors a divided input voltage VIN2 (=VIN×[R4/(R3+R4)]) commensurate with the input voltage VIN.

Here, appropriately selecting the resistors 21 to 24 such that R1:R2=R3:R4 provides a configuration equivalent to one where the reference voltage adjuster 40 is differentially fed with the input voltage VIN and the output voltage VOUT, and it is thus possible to achieve effects similar to those achieved with the first embodiment (FIG. 5) described previously.

FIG. 11 depicts, as a specific circuit element for the current detector 50, a PMOSFET 51. The source and the gate of the PMOSFET 51 and the source and the gate of the output transistor 10 are respectively connected together. Thus through the drain of the PMOSFET 51 passes a sense current I51 that corresponds to 1/m of the output current IOUT, and the sense current I51 is fed as the control signal mentioned previously to the offset adder 41. In a case where the size ratio of the output transistor to the PMOSFET 51 is m:1 (where m>1), the sense current I51 just mentioned equals 1/m of the output current IOUT.

As shown in a balloon in FIG. 11, the current detector 50 may further include PMOSFETs 52 and 53 and a current source 54 as a biasing means for keeping the drain voltage of the PMOSFET 51 equal to the drain voltage of the output transistor 10 (i.e., the output voltage VOUT).

The source of the PMOSFET 52 is connected to the drain of the PMOSFET 51. The source of the PMOSFET 53 is connected to the drain of the output transistor 10 (i.e., the application terminal for the output voltage VOUT). The respective gates of the PMOSFETs 52 and 53 are both connected to the drain of the PMOSFET 53. The drain of the PMOSFET 53 is connected to the first terminal of the current source 54. The second terminal of the current source 54 is connected to the grounded terminal.

Providing a biasing means as described above helps keep the drain-source voltage of the PMOSFET 51 equal to the drain-source voltage of the output transistor 10. It is thus possible to more accurately generate the sense current I51 commensurate with the output current IOUT (hence the control signal to the offset adder 41).

Fourth Embodiment

Figure 12:
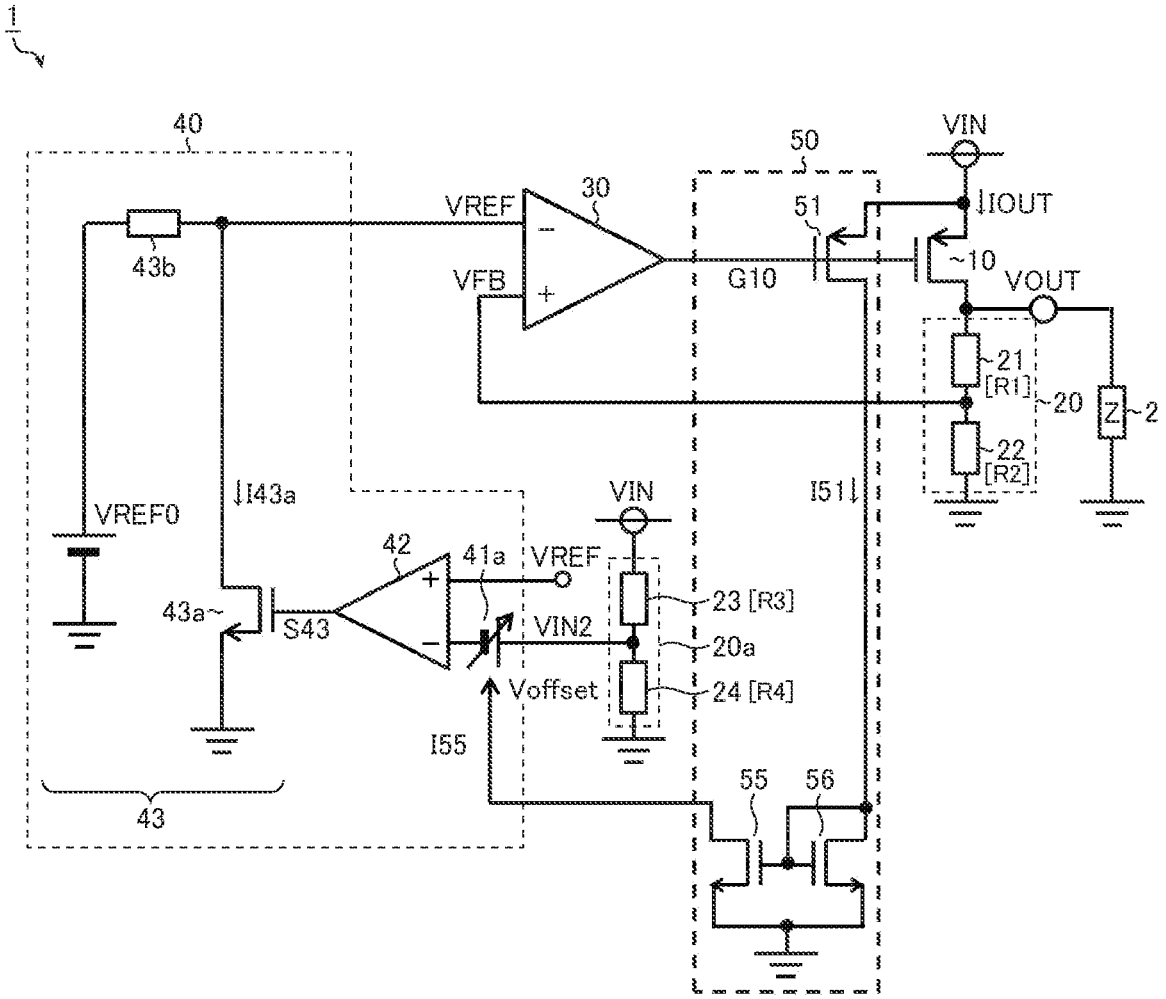
FIG. 12 is a diagram showing a linear power supply according to a fourth embodiment.

FIG. 12 is a diagram showing a linear power supply according to a fourth embodiment. The linear power supply 1 of this embodiment is based on the third embodiment (FIG. 11) described previously, but has a few modifications made to it.

First, the reference voltage adjuster 40 includes, instead of the offset adder 41 that shifts the reference voltage VREF to the high-potential side by the offset voltage Voffset, an offset adder 41*a* that shifts the divided input voltage VIN2 to the low-potential side by the offset voltage Voffset. That is, the differential amplifier 42 is differentially fed with the reference voltage VREF and the offset divided input voltage (=VIN2−Voffset). In this way, the offset voltage Voffset may, instead of being added to the reference voltage VREF, be subtracted from the divided input voltage VIN2.

Moreover, the current detector 50 further includes NMOSFETs 55 and 56 as a current mirror for generating a mirror current 155 commensurate with the sense current I51. The drain of the NMOSFET 56 is connected to the drain of the PMOSFET 51 (i.e., an output terminal for the sense current I51). The respective gates of the NMOSFETs 55 and 56 are connected to the drain of the NMOSFET 56. The respective sources of the NMOSFETs 55 and 56 are connected to the grounded terminal. The drain of the NMOSFET 55 is, as an output terminal for the mirror current I55, connected to the offset adder 41*a*. In this way, as the control signal for the offset adder 41*a*, a mirror current I55 commensurate with the sense current I51 may be used.

Fifth Embodiment

Figure 13:
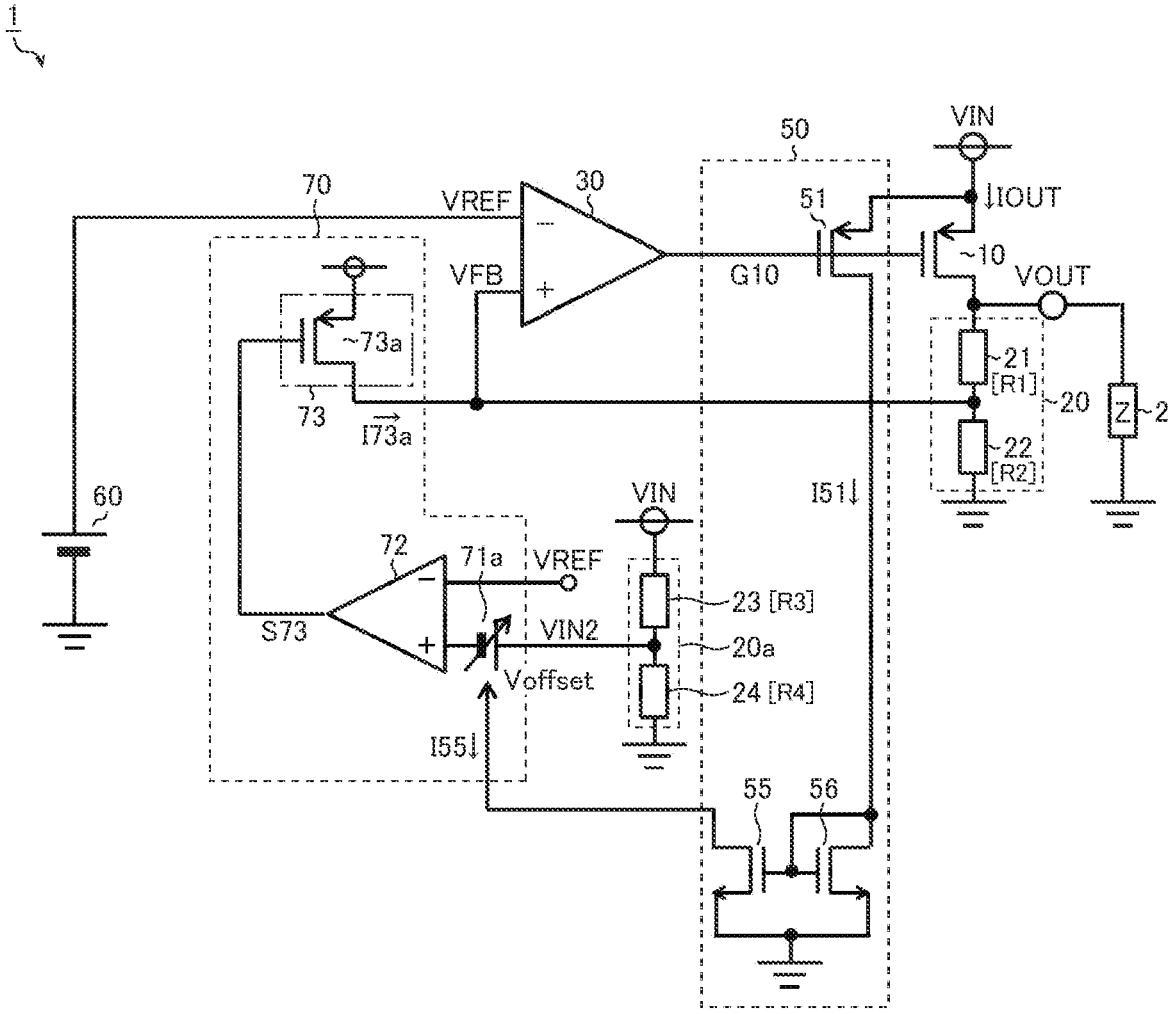
FIG. 13 is a diagram showing a linear power supply according to a fifth embodiment.

FIG. 13 is a diagram showing a linear power supply according to a fifth embodiment. The linear power supply 1 of this embodiment is based on the second embodiment (FIG. 10) described previously, but has a few modifications made to it.

First, as in the third and fourth embodiments (FIGS. 11 and 12 respectively) described previously, the linear power supply 1 further includes a voltage divider 20*a* that generates from the input voltage VIN a divided input voltage VIN2. As the differential input signal to the feedback voltage adjuster 70, instead of the input voltage VIN the divided input voltage VIN2 is used, and instead of the output voltage VOUT the reference voltage VREF is used. Also here R1:R2=R3:R4 holds as previously described.

Moreover, the feedback voltage adjuster 70 includes, instead of the offset adder 71 that shifts the output voltage VOUT to the high-potential side by the offset voltage Voffset, an offset adder 71*a* that shifts the divided input voltage VIN2 to the low-potential side by the offset voltage Voffset. That is, the differential amplifier 72 is differentially fed with the reference voltage VREF and the offset divided input voltage (=VIN2−Voffset). In this way, the offset voltage Voffset may, instead of being added to the reference voltage VREF, be subtracted from the divided input voltage VIN2.

Furthermore, the variable voltage source 73 includes a PMOSFET 73*a* of which the conductivity is controlled based on the control signal S73 output from the differential amplifier 72. The gate of the PMOSFET 73*a* is connected to the output terminal of the differential amplifier 72 (i.e., an application terminal for the control signal S73). The drain of the PMOSFET 73*a* (an output terminal for the drain current I73*a*) is connected to an application terminal for the feedback voltage VFB (the connection node between the resistors 21 and 22). The source of the PMOSFET 73*a* is connected to an internal power source that has a sufficient current capacity to supply the drain current I73*a*.

The use of the PMOSFET 73*a* as the variable voltage source 73 entails the reversal of the input polarities of the differential amplifier 72. More specifically, the inverting input terminal (−) of the differential amplifier 72 is fed with the reference voltage VREF, and the non-inverting input terminal (+) of the differential amplifier 72 is fed with the offset divided input voltage (=VIN2−Voffset).

With this configuration, in accordance with the drain current I73*a* that passes through the PMOSFET 73*a*, the feedback voltage VFB can be adjusted. Specifically, while the control signal S73 is kept at high level, the PMOSFET 73*a* is off; thus the drain current I73*a* does not pass. Accordingly the feedback voltage VFB is not shifted but is as it is fed to the non-inverting input terminal (+) of the driver 30. On the other hand, when the control signal S73 falls from high level, the lower its voltage value, the higher the conductivity oft PMOSFET 73*a* and thus the higher the drain current I73*a* that passes through the resistor 22; thus the feedback voltage VFB is shifted to the high-potential side accordingly.

Moreover, as in the fourth embodiment (FIG. 12) described previously, the current detector 50 includes a PMOSFET 51 and the NMOSFETs 55 and 56, and feeds the previously-mentioned mirror current I55 to the offset adder 71*a*. In this way, as the control signal for the offset adder 71*a*, for example, a mirror current I55 commensurate with the sense current I51 can be used.

Sixth Embodiment

Figure 14:
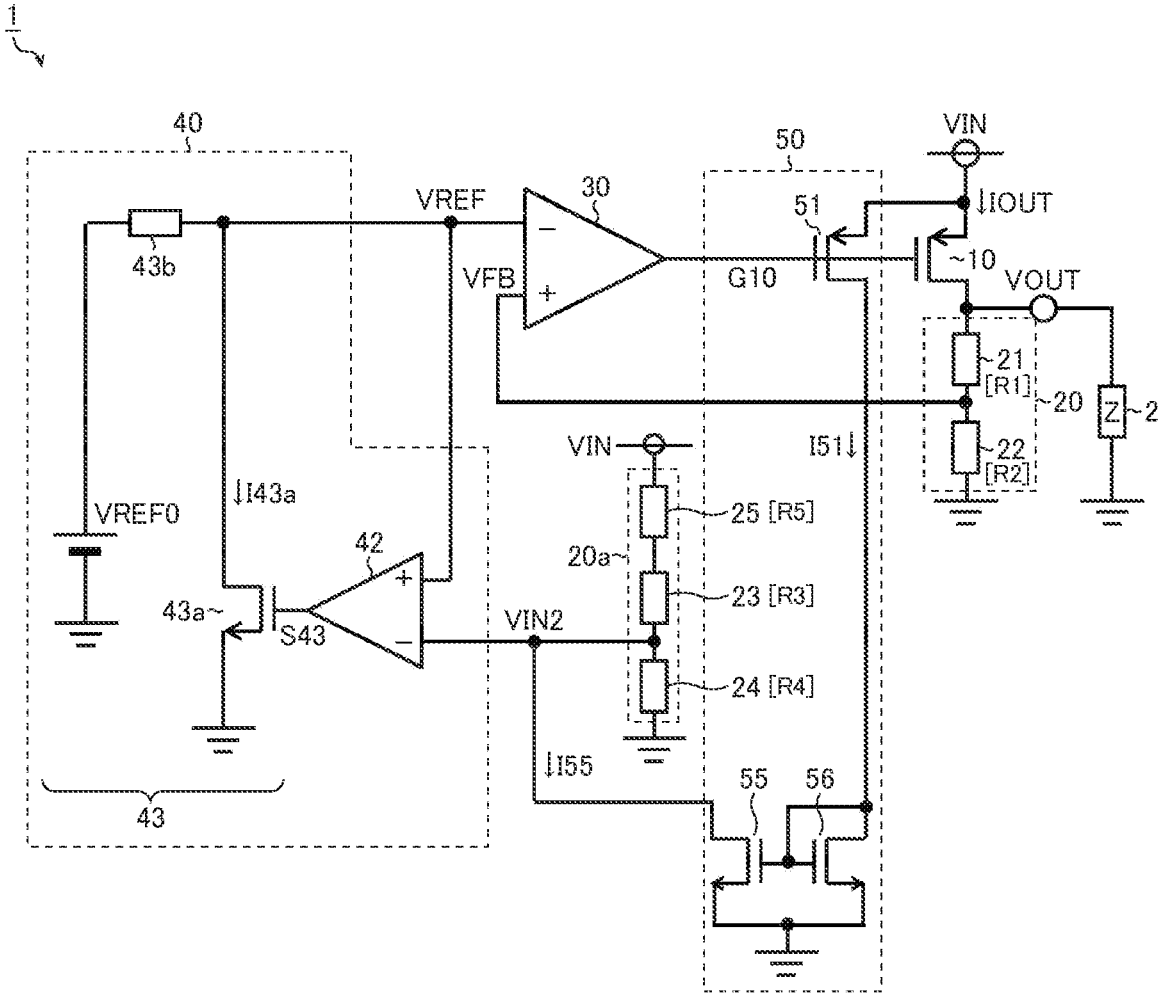
FIG. 14 is a diagram showing a linear power supply according to a sixth embodiment.

FIG. 14 is a diagram showing a linear power supply according to a sixth embodiment. The linear power supply 1 of this embodiment is based on the fourth embodiment (FIG. 12) described previously, and includes, instead of the offset adder 41*a*, a resistor 25 (with a resistance value R5). The resistor 25 is, as a circuit element of the voltage divider 20*a*, connected between the application terminal for the input voltage VIN and a resistor 23. In the current detector 50, the mirror current I55 is drawn from the output terminal for the input voltage VIN (i.e., the connection node between the resistors 23 and 24) toward the grounded terminal.

Here, appropriately selecting the resistors 21 to 24 such that R1:R2=R3:R4 makes it possible, owing to a deviation in resistance ratio resulting from the insertion of the resistor 25, to generate the offset voltage Voffset.

Seventh Embodiment

Figure 15:
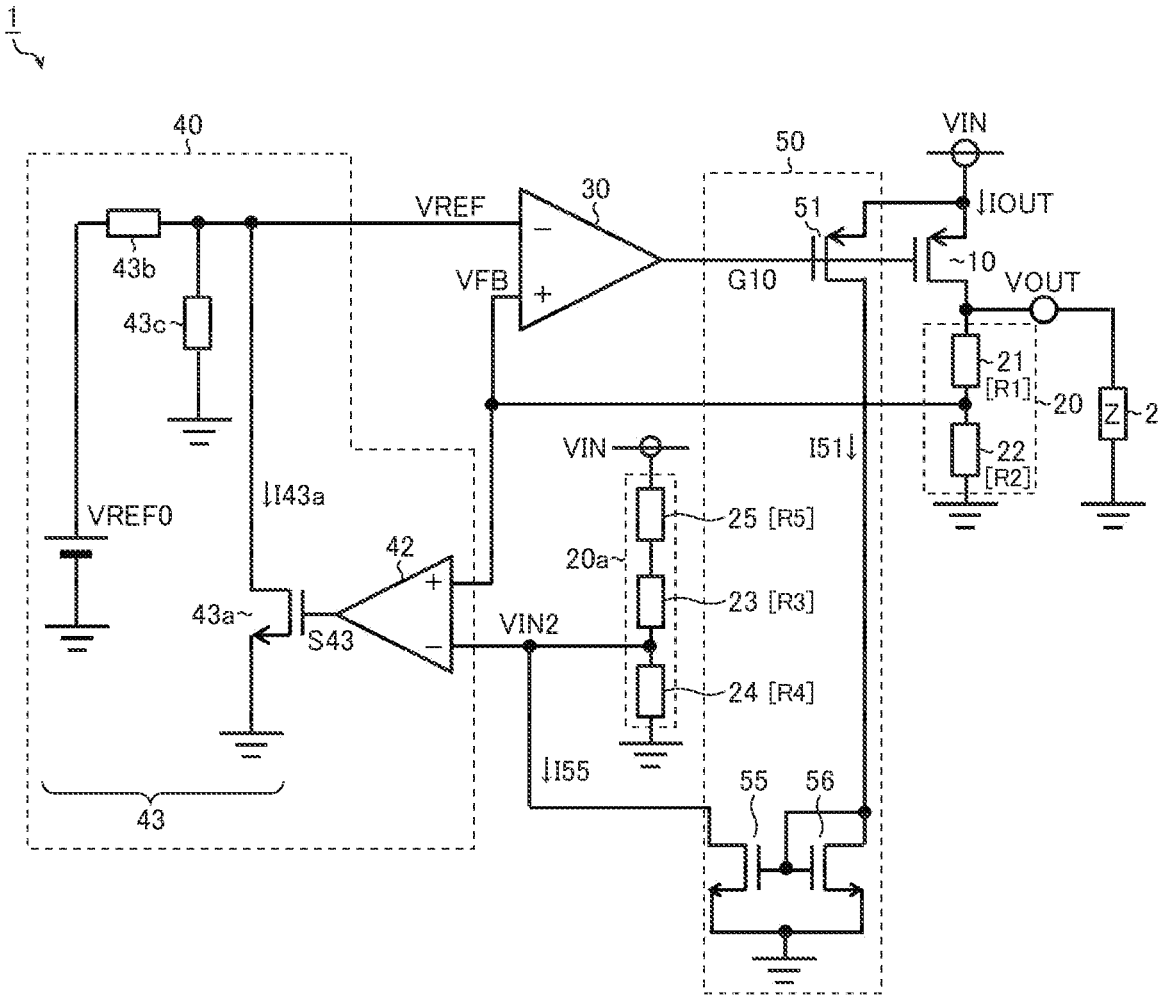
FIG. 15 is a diagram showing a linear power supply according to a seventh embodiment.

FIG. 15 is a diagram showing a linear power supply according to a seventh embodiment. The linear power supply 1 of this embodiment is based on the fourth embodiment (FIG. 12) described previously, but has a few modifications made to it.

First, the non-inverting input terminal (+) of the differential amplifier 42 is fed with, instead of the reference voltage VREF, the feedback voltage VFB (i.e., a division voltage of the output voltage VOUT). In this way, in the reference voltage adjuster 40, the reference voltage VREF may be adjusted such that the differential voltage (=VIN2−VFB) between the divided input voltage VIN2 and the feedback voltage VFB does not fall below the offset voltage Voffset.

Moreover, the reference voltage adjuster 40 further includes a resistor 43*c* (with a resistance value R43*c*) connected between the output terminal for the reference voltage VREF and the grounded terminal. In this case, the steady-state value of the reference voltage VREF (i.e., the reference voltage VREF as it is when the drain current I43*a* equals 0 A) equals VREF0×[R43*c*/(R43*b*+R43*c*)]. In this way, the steady-state value of the reference voltage VREF may be set by dividing a given constant voltage (VREF0).

Eighth Embodiment

Figure 16:
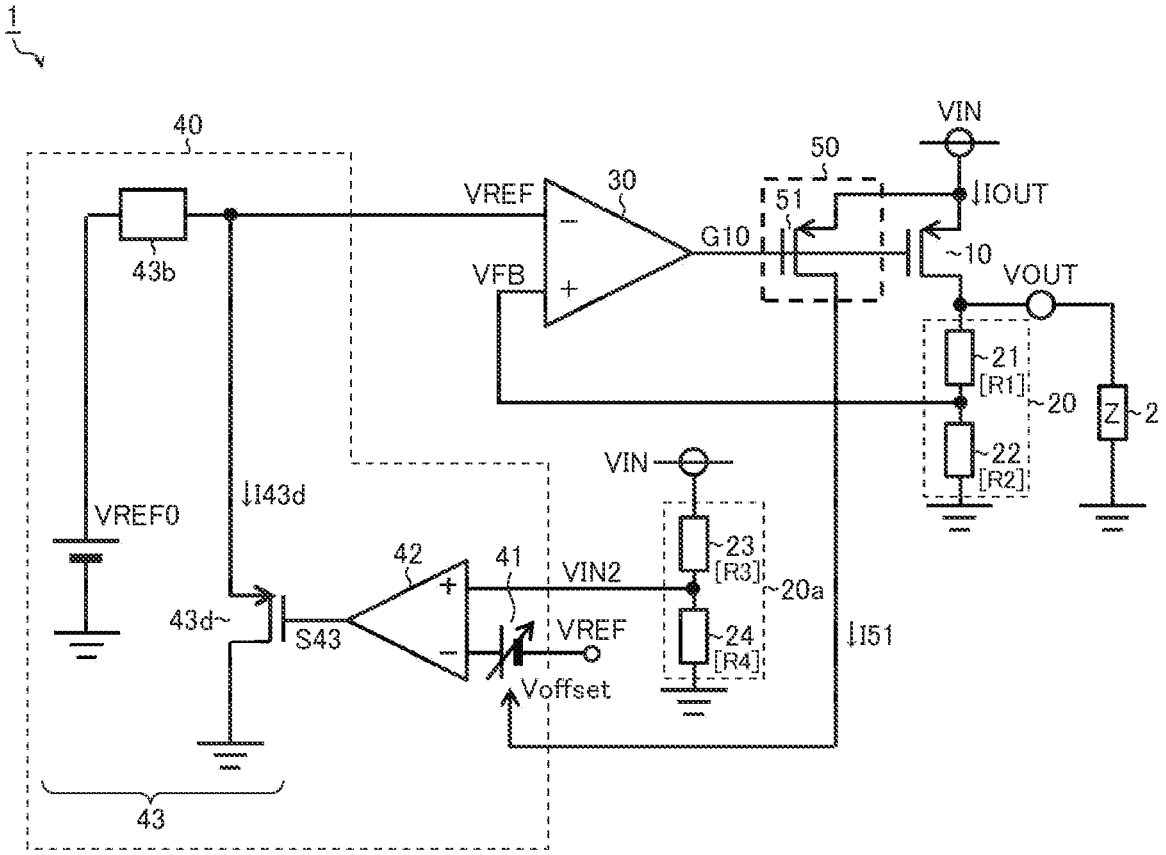
FIG. 16 is a diagram showing a linear power supply according to an eighth embodiment.

FIG. 16 is a diagram showing a linear power supply according to an eighth embodiment. The linear power supply 1 of this embodiment is based on the third embodiment (FIG. 11) described previously, but has the NMOSFET 43*a* in the reference voltage adjuster 40 replaced with a PMOSFET 43*d*. The source current I43*d* that passes through the PMOSFET 43*d* is lower the higher the control signal S43, and is higher the lower the control signal S43.

The above modification entails the reversal of the input polarities of the differential amplifier 42. More specifically, the differential amplifier 42 generates the control signal S43 for the variable voltage source 43 (i.e., the gate signal for the PMOSFET 43*d*) in accordance with the input voltage VIN, which is fed to the non-inverting input terminal (+) of the differential amplifier 42, and the offset output voltage (=VOUT+Voffset), which is fed to the inverting input terminal (−) of the differential amplifier 42.

The linear power supply 1 of this embodiment provides workings and effects similar to those achieved with the third embodiment (FIG. 11) described previously.

Combinations of First to Eighth Embodiments

The first to eighth embodiments that have been described above can be implemented in any combination unless inconsistent. For example, in the fourth, sixth, or seventh embodiment (FIG. 12, 14, or 15 respectively), the NMOSFET 43*a* may be replaced with a PMOSFET 43*d* with the input polarities of the differential amplifier 42 reversed.

Next, prior to a description of other novel embodiments (a ninth to a fifteenth embodiment), comparative examples to be compared with them will be described in brief.

First Comparative Example

Figure 17:
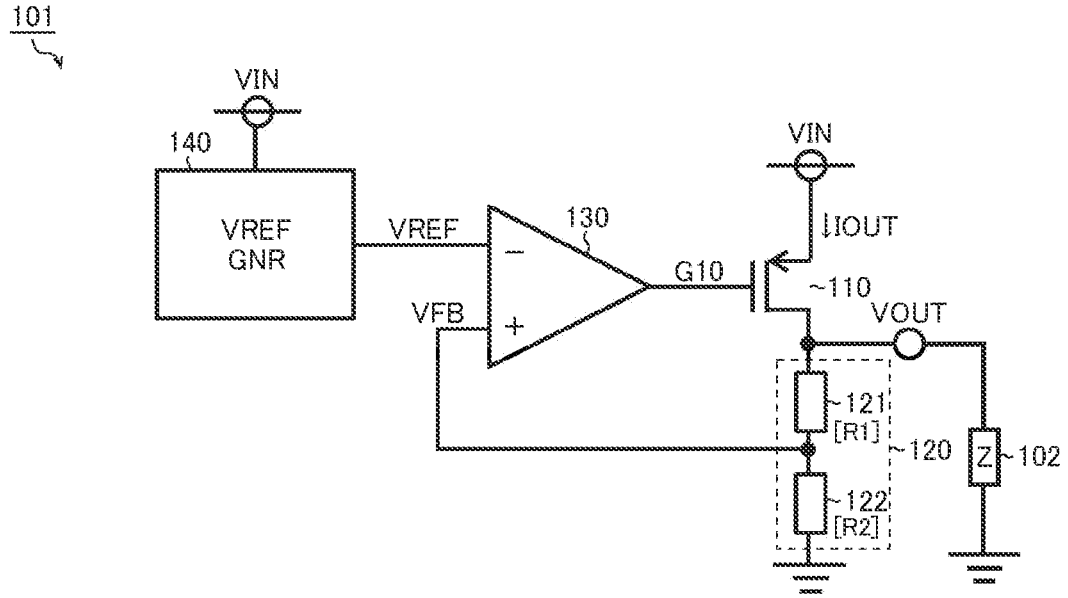
FIG. 17 is a diagram showing a linear power supply of a first comparative example.

FIG. 17 is a diagram showing a linear power supply of a first comparative example. The linear power supply 101 of the first comparative example includes an output transistor 110, a voltage divider 120, an amplifier 130, and a reference voltage generator 140. The linear power supply 101 bucks (steps down) an input voltage VIN to generate a desired output voltage VOUT. The input voltage VIN is supplied from a battery or the like (not shown), and so is not necessarily stable. The output voltage VOUT is supplied to a load 102 (i.e., a secondary power supply, a microcomputer, or the like) in the succeeding stage. The linear power supply 101 can be used as, for example, a reference voltage source incorporated in an IC.

The output transistor 110 is connected between an input terminal for the input voltage VIN and an output terminal for the output voltage VOUT, and the conductivity of the output transistor 110 (reversely put, its on-state resistance value) is controlled in accordance with a gate signal G10 from the amplifier 130. In the illustrated example, as the output transistor 110, a PMOSFET (P-channel MOSFET) is used. Accordingly, the lower the gate signal G10, the higher the conductivity of the output transistor 110, and thus the higher the output voltage VOUT; the higher the gate signal G10, the lower the conductivity of the output transistor 110, and thus the lower the output voltage VOUT. As the output transistor 110, instead of a PMOSFET, an NMOSFET may be used, or a bipolar transistor may be used.

The voltage divider 120 includes resistors 121 and 122 (with resistance values R1 and R2) that are connected in series between the output terminal for the output voltage VOUT and a grounded terminal, and outputs from the connection node between those resistors a feedback voltage VFB (=VOUT×[R2/(R1+R2)]) commensurate with the output voltage VOUT. Instead, in a case where the output voltage VOUT falls within the input dynamic range of the driver 130, the voltage divider 120 may be omitted, in which case, as the feedback voltage VFB, the output voltage VOUT itself may be fed directly to the amplifier 130.

The amplifier 130 drives the output transistor 110 by generating the gate signal G10 such that the feedback voltage VFB, which is fed to the non-inverting input terminal (+) of the amplifier 130, remains equal to a predetermined reference voltage VREF, which is fed to the inverting input terminal (−) of the amplifier 130. More specifically, the larger the difference ΔV (=VFB−VREF) between the feedback voltage VFB and the reference voltage VREF, the more the amplifier 130 raises the gate signal G10; the smaller the difference ΔV, the more the amplifier 130 lowers the gate signal G10.

The reference voltage generator 140 generates from the input voltage VIN the reference voltage VREF (with a fixed value). Suitably usable as the reference voltage generator 140 is, for example, a band-gap voltage source, which has low supply dependence and low temperature dependence.

Input Transient Response Characteristics (First Comparative Example)

Figure 18:
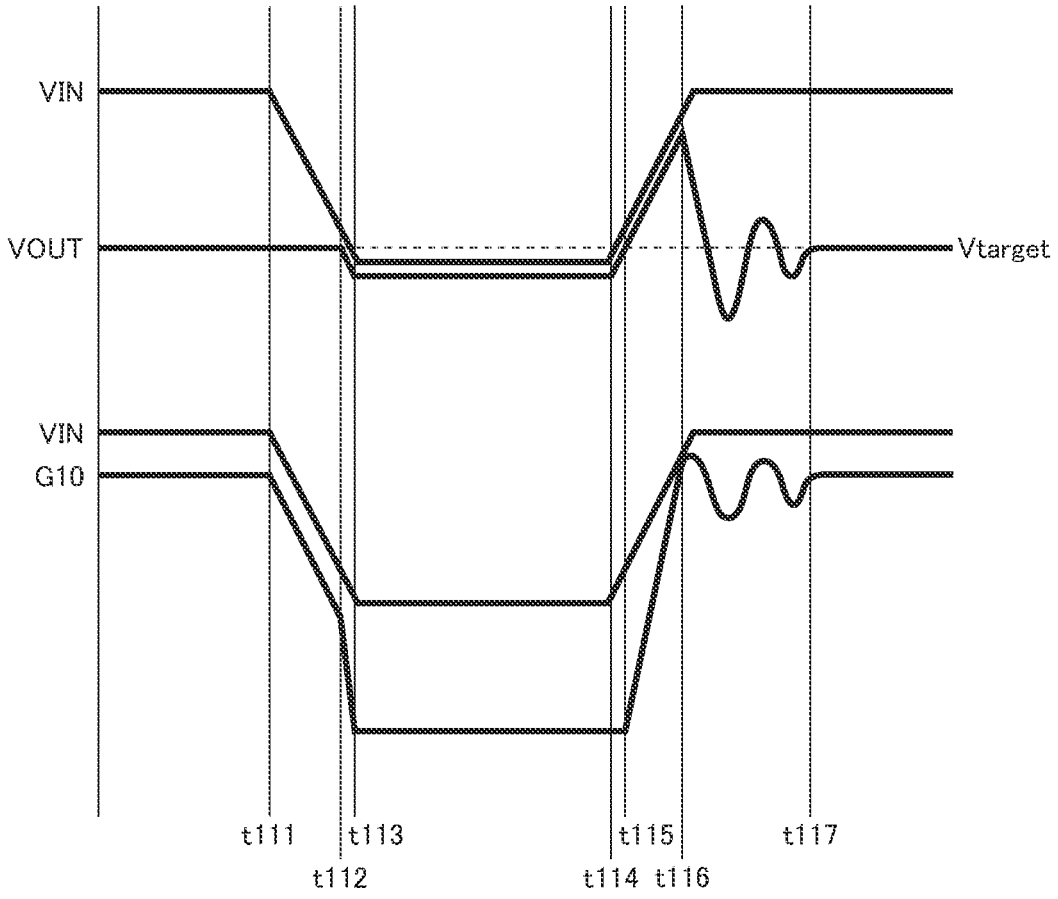
FIG. 18 is a diagram showing input transient response characteristics observed in the first comparative example.

FIG. 18 is a diagram showing input transient response characteristics observed in the first comparative example. FIG. 18 depicts, in the upper tier, the relationship between the input voltage VIN and the output voltage VOUT and, in the lower tier, the relationship between the input voltage VIN and the gate signal G10.

In a case where the reference voltage VREF has a fixed value, when the input voltage VIN falls until it becomes lower than a target output value Vtarget (a target value for the output voltage VOUT), the feedback voltage VFB stays constantly below the reference voltage VREF. As a result, the amplifier 130 enters a state in which it has lowered the gate signal G10 to as low a level as it can, and thus the output transistor 110 enters the fully on state (see from time point t112 to time point t115). That is, the amplifier 130 enters a state in which it operates like a comparator.

When from this state the input voltage VIN rises sharply to a voltage higher than the target output value Vtarget, the amplifier 130 tends to raise the gate signal G10 to turn off the output transistor 110. However, the gate signal G10, now fallen fully down to low level, is difficult to raise in a way to immediately follow the sharp change in the input voltage VIN. As a result, with the output transistor 110 left in the fully on state, the input voltage VIN is output as it is, causing an overshoot in the output voltage VOUT (see from time point t115 to time point t117). Such an overshoot may lead to the load 102 malfunctioning or breaking down.

The speed at which the output transistor 110 is turned off depends on the response speed of the amplifier 130, the current capacity in the output stage of the amplifier 130, the impedances of internal terminals in the amplifier 130, the gate capacity of the output transistor 110, etc. On the other hand, the convergence time of an overshoot depends on the characteristics (phase margin, response speed) of the amplifier 130.

Second Comparative Example

Figure 19:
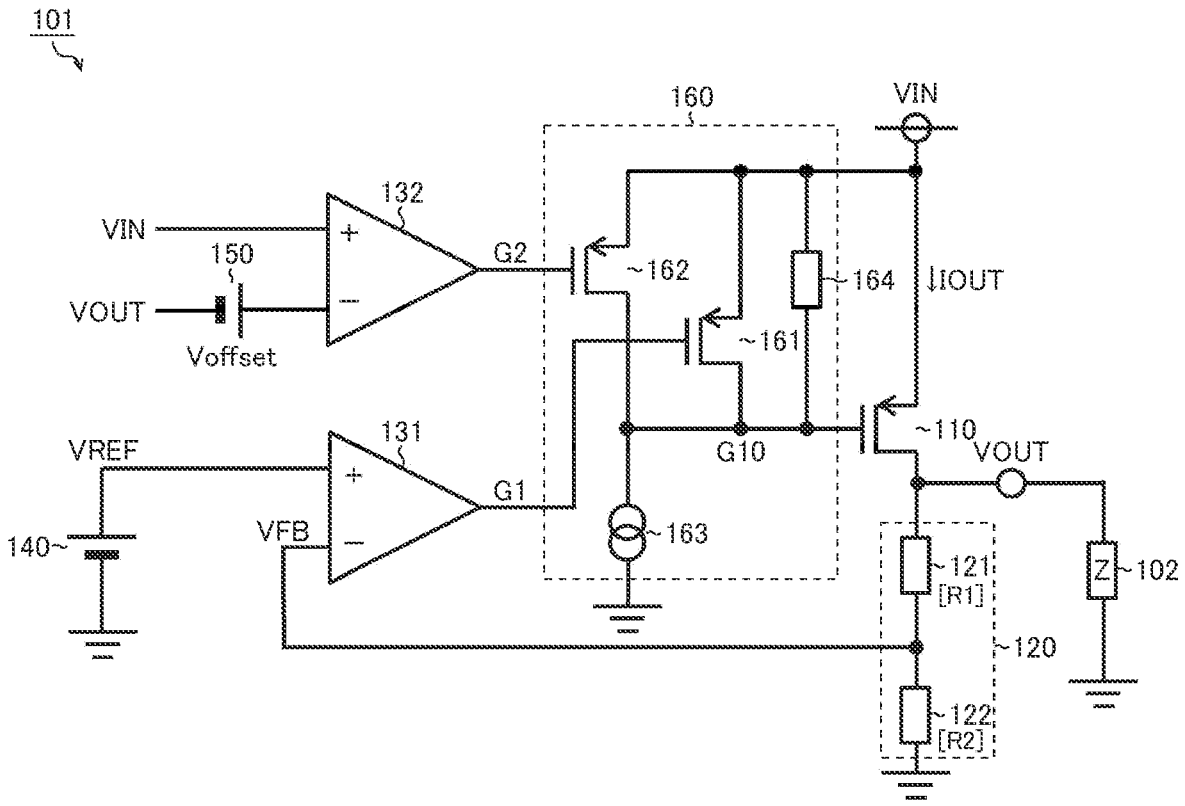
FIG. 19 is a diagram showing a linear power supply of a second comparative example.

FIG. 19 is a diagram showing a linear power supply of a second comparative example. The linear power supply 101 of the second comparative example includes an output transistor 110, a voltage divider 120, amplifiers 131 and 132, a reference voltage generator 140, an offset adder 150, and a gate driver 160. The linear power supply 101 bucks (steps down) an input voltage VIN to generate a desired output voltage VOUT. Such circuit elements as have been described previously are identified by the same reference signs as in FIG. 17, and no overlapping description will be repeated.

The amplifier 131 outputs a gate signal G1 (corresponding to a first driving signal) by amplifying the difference (=VREF−VFB) between the feedback voltage VFB, which is fed to the inverting input terminal (−) of the amplifier 131, and the reference voltage VREF, which is fed to the non-inverting input terminal (+) of the amplifier 131. The amplifier 131 constitutes a first output feedback loop for keeping the feedback voltage VFB and the reference voltage VREF equal.

The amplifier 132 outputs a gate signal G2 (corresponding to a second driving signal) by amplifying the difference (=VIN−(VOUT+Voffset)) between the input voltage VIN, which is fed to the non-inverting input terminal (+) of the amplifier 132, and the offset output voltage (=VOUT+Voffset), which is fed to the inverting input terminal (−) of the amplifier 132. The amplifier 132 constitutes a second output feedback loop for keeping the input voltage VIN and the offset output voltage (=VOUT+Voffset) equal.

The offset adder 150 is a circuit block that feeds the amplifier 132 with a predetermined offset voltage Voffset. More specifically, the offset adder 150 feeds the output voltage VOUT, for example after shifting it to the high-potential side by the predetermined offset voltage Voffset, to the non-inverting input terminal (+) of the amplifier 132. Preferably the offset voltage Voffset is set at a voltage value lower than the minimum input-output voltage difference VSAT defined for the linear power supply 101.

The gate driver 160 is a circuit block that, with the output terminal of the amplifier 131 diverted to it instead of being directly connected to the gate of the output transistor 110, receives the gate signals G1 and G2 parallelly as a two-channel output feedback signals to generate, in accordance with the gate signals G1 and G2, the gate signal G10 for the output transistor 110. The gate driver 160 includes PMOSFETs 161 and 162, a current source 163, and a resistor 164.

The source of the PMOSFET 161 is connected to the input terminal for the input voltage VIN. The drain of the PMOSFET 161 is connected to the gate of the output transistor 110. The gate of the PMOSFET 161 is connected to an application terminal for the gate signal G1 (i.e., the output terminal of the amplifier 131). Thus the conductivity of the PMOSFET 161 varies with the gate signal G1.

The source of the PMOSFET 162 is connected to the input terminal for the input voltage VIN. The drain of the PMOSFET 162 is connected to the gate of the output transistor 110. The gate of the PMOSFET 162 is connected to an application terminal for the gate signal G2 (i.e., the output terminal of the amplifier 132). Thus the conductivity of the PMOSFET 162 varies with the gate signal G2.

The current source 163 is connected between the gate of the output transistor 110 and the grounded terminal, and generates a predetermined constant current.

The resistor 164 is a resistor with a high resistance value (e.g., several megohms) connected between the input terminal for the input voltage VIN and the gate of the output transistor 110.

Input Transient Response Characteristics (in Light-Load Region)

Figure 20:
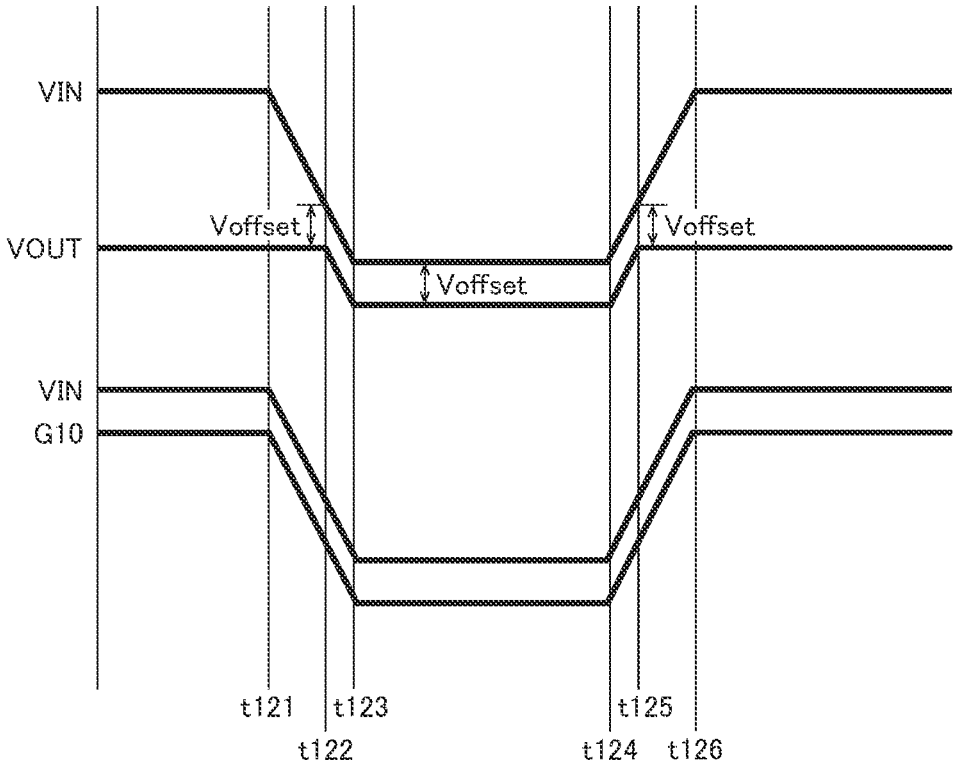
FIG. 20 is a diagram showing input transient response characteristics observed in the second comparative example (in a light-load region)

FIG. 20 is a diagram showing input transient response characteristics observed in the second comparative example (in a light-load region). Like FIG. 18 referred to previously, FIG. 20 depicts, in the upper tier, the relationship between the input voltage VIN and the output voltage VOUT and, in the lower tier, the relationship between the input voltage VIN and the gate signal G10.

When the differential voltage (=VIN−VOUT) between the input voltage VIN and the output voltage VOUT is higher than the offset voltage Voffset, the amplifier 132 keeps the gate signal G2 raised at high level, and thus the PMOSFET 162 is off. Accordingly the amplifier 131 performs ordinary output feedback control (see before time point t122 or after time point t125).

On the other hand, when the differential voltage (=VIN−VOUT) between the input voltage VIN and the output voltage VOUT falls down to the offset voltage Voffset, the amplifier 132 so operates as to apply output feedback control such that the input voltage VIN and the offset output voltage (=VOUT+Voffset) are imaginarily short-circuited together. Specifically, the conductivity of the PMOSFET 162 is changed such that the differential voltage (=VIN−VOUT) between the input voltage VIN and the output voltage VOUT does not become higher than the offset voltage Voffset (see from time point t122 to time point t125).

As a result, the gate signal G10 for the output transistor 110 for the output transistor 110 now changes so as to follow the input voltage VIN while keeping a constant potential difference with respect to the input voltage VIN. That is, the gate signal G10 is no longer pegged at low level, and thus the output transistor 110 does not enter the fully on state.

Once in this way the output transistor 110 is prevented from entering the fully on state in response to a fall in the input voltage VIN, even if thereafter the input voltage VIN rises sharply, the gate signal G10 can be raised in a way to immediately follow the gate signal G10. It is thus possible to minimize an overshoot in output voltage VOUT.

Keeping the differential voltage (=VIN−VOUT) between the input voltage VIN and the output voltage VOUT equal to the offset voltage Voffset entails the output voltage VOUT falling below the intended target output value Vtarget as the input voltage VIN falls. A fall in the output voltage VOUT may lead to degraded characteristics in the load 102 that is connected in the succeeding stage, and thus the offset voltage Voffset needs to be adjusted within such a range as not to bring an adverse effect.

One possible criterion is the minimum input-output voltage difference VSAT defined for the linear power supply 101. The minimum input-output voltage difference VSAT corresponds to the lowest input-output voltage difference (i.e., the differential voltage (=Vin−VOUT) between the input voltage VIN and the output voltage VOUT) that is needed to stably supply a predetermined output current IOUT from the linear power supply 101 to the load 102; generally the minimum input-output voltage difference VSAT depends on the on-state resistance value RON of the output transistor 110 in the fully on state and the current value of the output current IOUT that passes in that state.

In view of the foregoing, it can safely be said that preferably the offset voltage Voffset (corresponding to the degree of the lowering of the output voltage VOUT in response to a fall in the input voltage VIN) is set at a voltage value lower than the minimum input-output voltage difference VSAT. With such a voltage selected, even if the reference voltage adjustment operation described above causes a fall in the output voltage VOUT, it does not interfere with the stable operation of the linear power supply 1.

Input Transient Response Characteristics (in Heavy-Load Region)

Though no mention has been made with reference to FIGS. 18 and 20, the output transistor 110 even in the fully on state has an on-state resistance value RON, which inevitably produces between its drain and source a drain-source voltage Vds (=IOUT×RON) in accordance with the output current IOUT.

Here, in a load region where the output current IOUT passing through the output transistor 110 is low and IOUT×RON<Voffset (called a light-load region in the following description), the output feedback control by the amplifier 132 works effectively, so as to suppress an overshoot in the output voltage VOUT resulting from a sharp change in the input voltage VIN.

On the other hand, in a load region where the output current IOUT passing through the output transistor 110 is high and IOUT×RON>Voffset (called a heavy-load region in the following description), the differential voltage (VIN−VOUT) between the input voltage VIN and the output voltage VOUT does not fall below the offset voltage Voffset. As a result, the gate signal G2 is constantly at high level, and thus the NMOSFET 43*a* is kept off, bringing a state where the output feedback control by the amplifier 132 does not work.

Figure 21:
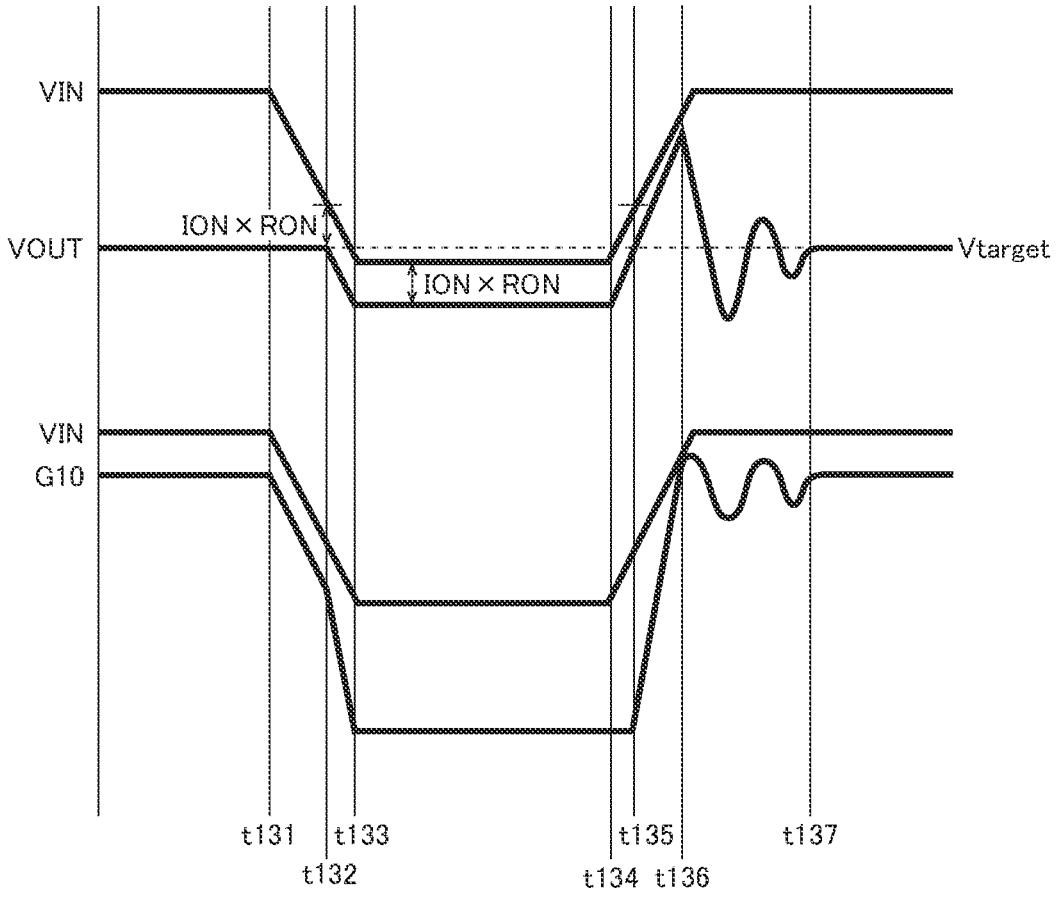
FIG. 21 is a diagram showing input transient response characteristics observed in the second comparative example (in a heavy-load region)

FIG. 21 is a diagram showing input transient response characteristics observed in the second comparative example (in a heavy-load region). Like FIGS. 18 and 20 referred to previously, FIG. 21 shows, in the upper tier, the relationship between the input voltage VIN and the output voltage VOUT and, in the lower tier, the relationship between the input voltage VIN and the gate signal G10.

As mentioned previously, in a heavy-load region, the output feedback control by the amplifier 132 does not work. Thus, when the input voltage VIN falls until VIN<Vtarget+ION×RON, the output voltage VOUT can no longer be kept at the target output value Vtarget, and the feedback voltage VFB remains constantly below the reference voltage VREF. As a result, the amplifier 131 keeps the gate signal G1 raised at high level, and thus the PMOSFET 161 is off Thus the gate signal G10 is kept lowered at low level by the current source 163, and thus the output transistor 110 enters the fully on state (see from time point t132 to time point t135).

When from this state the input voltage VIN rises sharply until VIN>Vtarget+ION×RON, the amplifier 131 tends to lower the gate signal G1 to increase the conductivity of the PMOSFET 161, thereby to raise the gate signal G10 to turn off the output transistor 110. However, the gate signal G10, now fallen fully down to low level, is difficult to raise in a way to immediately follow the sharp change in the input voltage VIN. As a result, with the output transistor 110 left in the fully on state, the input voltage VIN is output as it is, causing an overshoot in the output voltage VOUT (see from time point t135 to time point t137).

As described above, the input transient response characteristics observed in a heavy-load region (FIG. 21) are no different from those in the first comparative example (FIG. 18).

Incidentally, the simplest solution to the inconvenience mentioned above is to raise the offset voltage Voffset. However, an offset voltage Voffset raised on a constant basis causes, in response to a fall in the input voltage VIN, a large fall in the output voltage VOUT irrespective of load heaviness, possibly leading to degraded characteristics.

Proposed below will be various embodiments that provide a solution to the inconvenience mentioned above.

Ninth Embodiment

Figure 22:
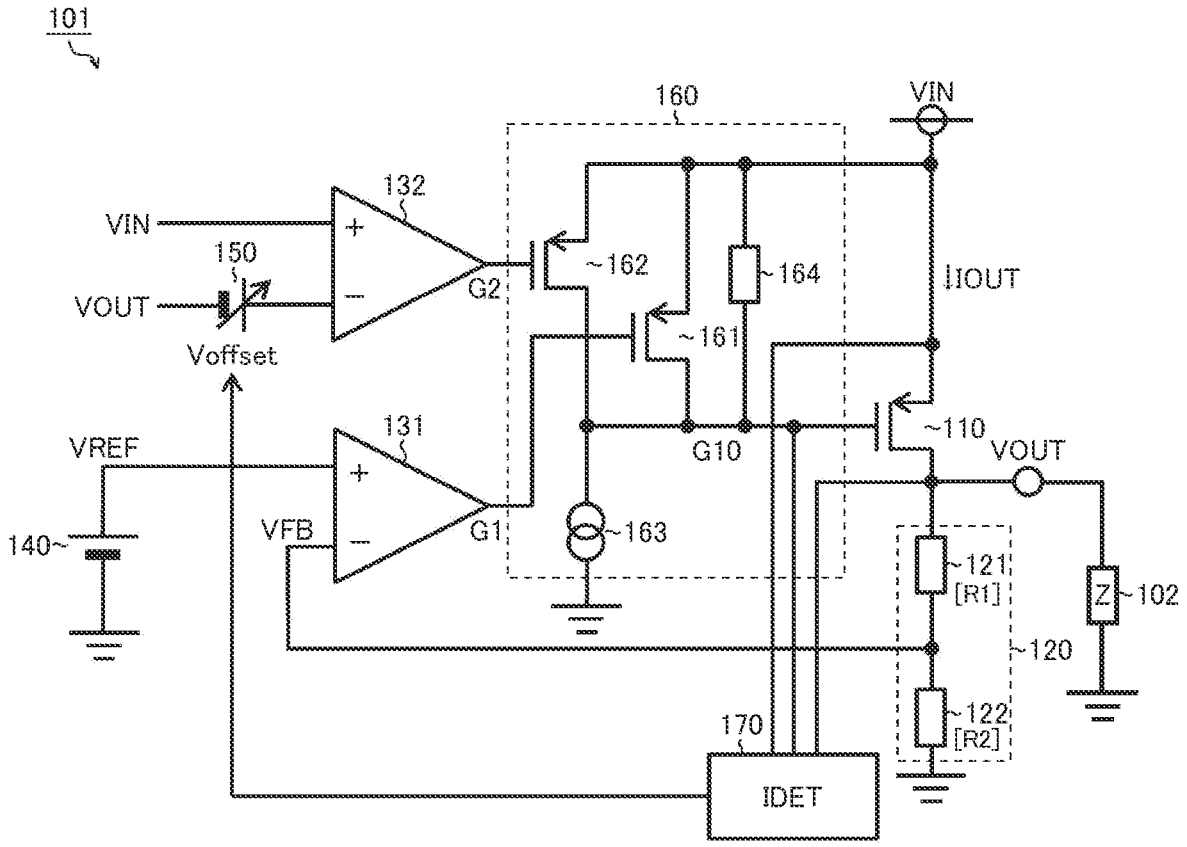
FIG. 22 is a diagram showing a linear power supply according to a ninth embodiment.

FIG. 22 is a diagram showing a linear power supply according to a ninth embodiment. The linear power supply 101 of this embodiment is based on the second comparative example (FIG. 19) described previously, and further includes a current detector 170.

The current detector 170 senses the output current IOUT that passes through the output transistor 110, and feeds a sense current commensurate with its current value (e.g., a sense current corresponding to 1/m of the output current IOUT, or a mirror current of such a sense current; more detail will be given later) to the offset adder 150.

The offset adder 150 is a circuit block that shifts the output voltage VOUT to the high-potential side by the offset voltage Voffset, and additionally has a function of variably controlling the offset voltage Voffset in accordance with a control signal from the current detector 170. The offset voltage Voffset is higher the higher the output current IOUT, and is lower the lower the output current IOUT.

FIGS. 6 to 8, referred to earlier, are each a correlation diagram of the output current IOUT (horizontal axis) versus the output voltage VOUT (vertical axis). FIG. 6 can be understood to depict output behavior observed in the first comparative example, and FIG. 7 can be understood to depict output behavior observed in the second comparative example (with Voffset fixed). On the other hand, FIG. 8 can be understood to depict output behavior observed in the ninth embodiment (with Voffset varied). For comparison, FIGS. 7 and 8 also show, with broken lines, output behavior observed in the first comparative example (FIG. 6). These diagrams will be studied comparatively in the following discussion of the advantages of the ninth embodiment.

First, the output behavior shown in FIG. 6 (the first comparative example) will be described. In this case, as the input voltage VIN falls, the output transistor 110 can enter the fully on state without any restriction; thus simply a voltage drop (=IOUT×RON) commensurate with the output current IOUT and the on-state resistance value RON of the output transistor 110 occurs. Accordingly, depending on the characteristics of the amplifier 130, the output voltage VOUT may suffer an overshoot in any load condition.

Next, the output behavior shown in FIG. 7 (the second comparative example, with Voffset fixed) will be described. In this case, in a light-load region (IOUT<Voffset/RON), even if the input voltage VIN falls, the output feedback control by the amplifier 132 works such that the differential voltage (=VIN−VOUT) between the input voltage VIN and the output voltage VOUT does not fall below the offset voltage Voffset. Accordingly, the output transistor 110 does not enter the fully on state, and the output voltage VOUT is prevented from suffering an overshoot.

However, in a heavy-load region (IOUT>Voffset/RON), the amplifier 132 no longer operates effectively. Accordingly, as the input voltage VIN falls, the output transistor 110 may enter the fully on state, and thus the output voltage VOUT may suffer an overshoot. Raising the offset voltage Voffset may widen the load range in which the amplifier 132 operates effectively, but as mentioned previously, that is done in a trade-off for a larger fall in output under a light load.

Next, the output behavior shown in FIG. 8 (the ninth embodiment, with Voffset varied) will be described. In this case, the offset voltage Voffset is variably controlled such that over the entire load region the offset voltage Voffset satisfies IOUT×RON<Voffset and in addition that the offset voltage Voffset is higher the higher the output current IOUT and is lower the lower the output current IOUT.

Accordingly, when the input voltage VIN falls, the output feedback control by the amplifier 132 works effectively irrespective of the load condition. As a result, it is possible to prevent the output transistor 110 from entering the fully on state over a wide load region, and hence to suppress an overshoot in the output voltage VOUT over a wide load region and thereby enhance the input transient response characteristics of the linear power supply 1.

Moreover, the offset voltage Voffset is set to be minimal in accordance with the output current IOUT; thus, in particular under no load (IOUT=0 A) or in a light-load region (IOUT<Voffset/RON), it is possible to prevent an unnecessary fall in the output voltage VOUT.

FIG. 9, referred to earlier, can be understood as a diagram showing input transient response characteristics observed in the ninth embodiment (with Voffset varied). FIG. 9 shows, in the upper tier, the relationship between the input voltage VIN and the output voltage VOUT and, in the lower tier, the relationship between the input voltage VIN and the gate signal G10.

With the linear power supply 101 of this embodiment, through the above-described operation of the amplifier 132, even when the input voltage VIN falls, the differential voltage (=VIN−VOUT) between the input voltage VIN and the output voltage VOUT can be kept equal to the offset voltage Voffset. Thus the output transistor 110 does not enter the fully on state, and the gate signal G10 is kept at an adequate voltage value. Certainly, as the load is increasingly heavy, the gate signal G10 falls to pass an increasingly high output current IOUT; even then the gate signal G10 is not lowered down to the ground level.

On the other hand, when differential voltage (=VIN−VOUT) between the input voltage VIN and the output voltage VOUT falls down to the offset voltage Voffset, through the operation of the amplifier 132, output feedback control is applied such that the input voltage VIN and the offset output voltage (=VOUT+Voffset) are imaginarily short-circuited together. Specifically, the conductivity of the PMOSFET 162 is changed such that the differential voltage (=VIN−VOUT) between the input voltage VIN and the output voltage VOUT does not become higher than the offset voltage Voffset (see, in FIG. 20 referred to previously, from time point t122 to time point t125).

As a result, the gate signal G10 for the output transistor 110 now changes so as to follow the input voltage VIN while keeping a predetermined potential difference with reference to the input voltage VIN. That is, the gate signal G10 is no longer pegged at low level, and thus the output transistor 110 does not enter the fully on state.

Preventing in this way the output transistor 110 from entering the fully on state in response to a fall in the input voltage VIN makes it possible, even if thereafter the input voltage VIN rises sharply, to raise the gate signal G10 in a way to immediately follow the sharp change. It is thus possible to minimize an overshoot in the output voltage VOUT.

Moreover, with the linear power supply 101 of this embodiment, in accordance with the output current IOUT, the offset voltage Voffset is variably controlled. This helps keep the degree of the lowering of the output voltage VOUT (i.e., the offset voltage Voffset) the smaller the lighter the load (the lower the output current IOUT). It is thus possible to keep an adequate output voltage VOUT.

Tenth Embodiment

Figure 23:
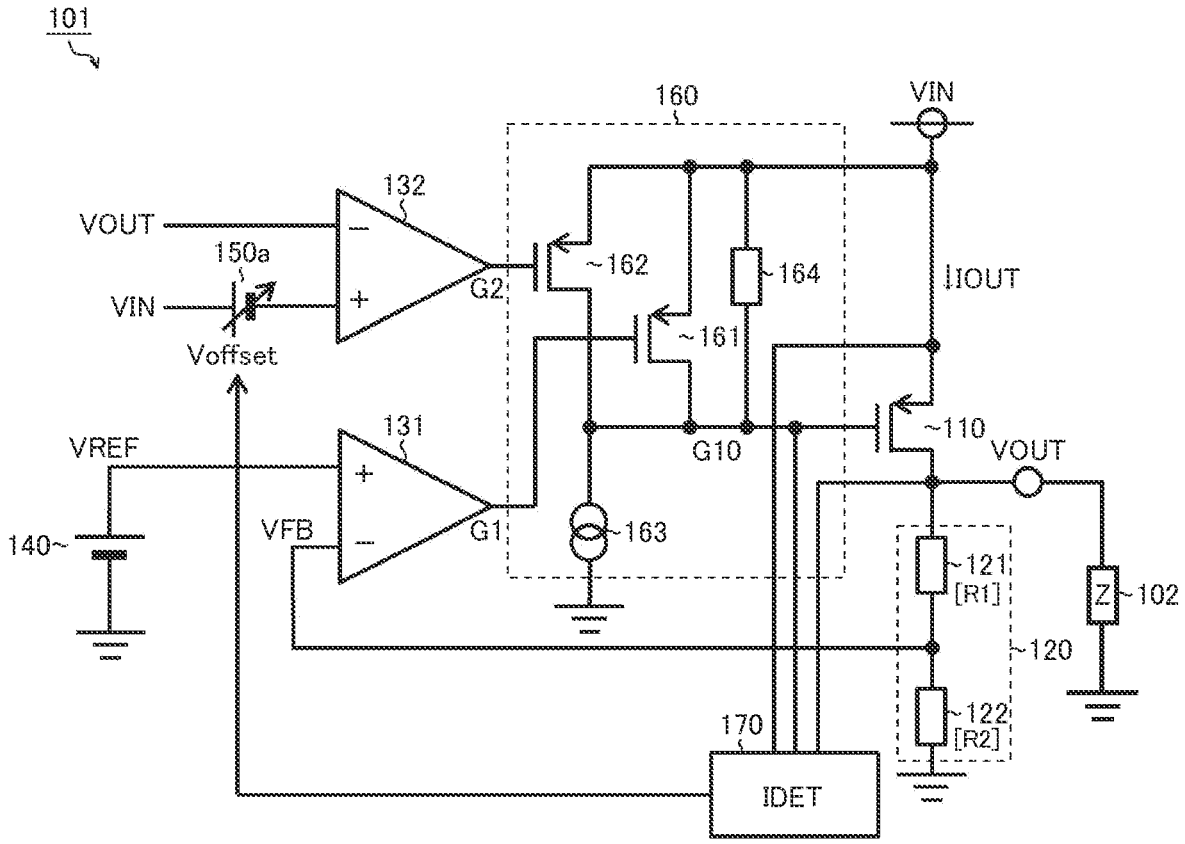
FIG. 23 is a diagram showing a linear power supply according to a tenth embodiment.

FIG. 23 is a diagram showing a linear power supply according to a tenth embodiment. The linear power supply 101 of this embodiment is based on the ninth embodiment (FIG. 22) described previously, and includes, instead of the offset adder 150 that offsets the output voltage VOUT, an offset adder 150*a* that offsets the input voltage VIN.

More specifically, the offset adder 150*a* feeds the input voltage VIN, after shifting it to the low-potential side by the offset voltage Voffset, to the non-inverting input terminal (+) of the amplifier 132. Moreover, as in the ninth embodiment (FIG. 22) described previously, the offset adder 150*a* has a function of variably controlling the offset voltage Voffset in accordance with a control signal from the current detector 170. Specifically, the offset voltage Voffset is higher the higher the output current IOUT, and is lower the lower the output current IOUT.

The amplifier 132 generates the gate signal G2 by amplifying the difference between the offset input voltage (=VIN−Voffset), which is fed to the non-inverting input terminal (+) of the amplifier 132, and the output voltage VOUT, which is fed to the inverting input terminal (−) of the amplifier 132.

Accordingly, when the differential voltage (=VIN−VOUT) between the input voltage VIN and the output voltage VOUT falls down to the offset voltage Voffset, through the operation of the amplifier 132, output feedback control is applied such that the offset input voltage (=VIN−Voffset) and the output voltage VOUT are imaginarily short-circuited together. As a result, the gate signal G10 for the output transistor 110 now changes so as to follow the input voltage VIN while keeping a predetermined potential difference with respect to the input voltage VIN. That is, the gate signal G10 is no longer pegged at low level, and thus the output transistor 110 does not enter the fully on state.

In this way, the offset voltage Voffset may, instead of being added to the output voltage VOUT, be subtracted from the input voltage VIN.

Eleventh Embodiment

Figure 24:
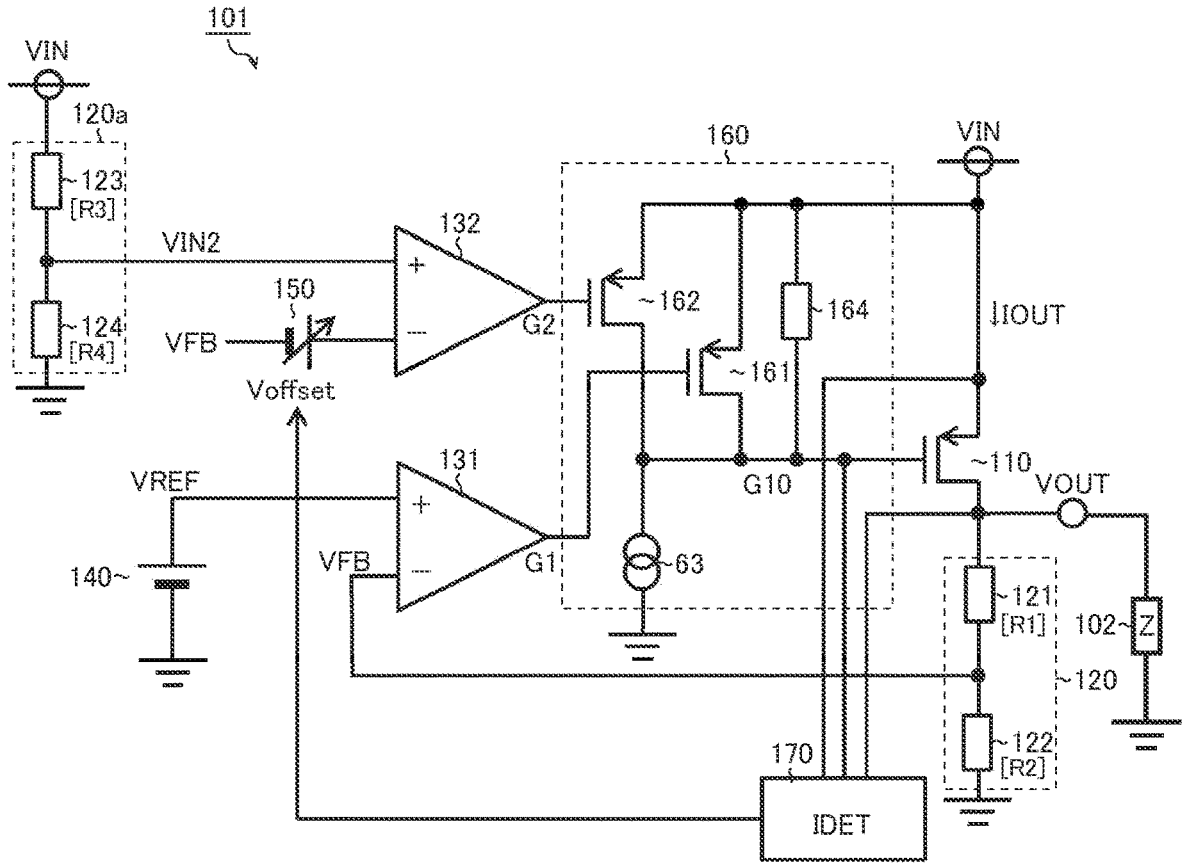
FIG. 24 is a diagram showing a linear power supply according to an eleventh embodiment.

FIG. 24 is a diagram showing a linear power supply according to an eleventh embodiment. The linear power supply 101 of this embodiment is based on the ninth embodiment (FIG. 22) described previously, and further includes a voltage divider 120*a* that generates from the input voltage VIN a divided input voltage VIN2. The amplifier 132 is fed with, instead of the input voltage VIN, the divided input voltage VIN2 and, instead of the output voltage VOUT, the feedback voltage VFB. Accordingly, in the offset adder 150, not the output voltage VOUT but the feedback voltage VFB is shifted to the high-potential side by the offset voltage Voffset. That is, the inverting input terminal (−) of the amplifier 132 is fed with the offset feedback voltage (=VFB+Voffset).

The voltage divider 120*a* includes resistors 123 and 124 (with resistance values R3 and R4) connected in series between the application terminal for the input voltage VIN and the grounded terminal, and outputs from the connection node between those resistors a divided input voltage VIN2 (=VIN×[R4/(R3+R4)]) commensurate with the input voltage VIN.

Here, appropriately selecting the resistors 121 to 124 such that R1:R2=R3:R4 provides a configuration equivalent to one where the amplifier 132 is differentially fed with the input voltage VIN and the output voltage VOUT, and it is thus possible to achieve effects similar to those achieved with the ninth embodiment (FIG. 22) described previously.

The voltage fed to the inverting input terminal (−) of the amplifier 132 is not limited to the feedback voltage VFB but may instead be any voltage that varies in a way to behave like the output voltage VOUT. For example, the output voltage VOUT can be divided in a voltage division ratio different from that in the voltage divider 120 so that the divided output voltage may be fed to the inverting input terminal (−) of the amplifier 132.

Twelfth Embodiment

Figure 25:
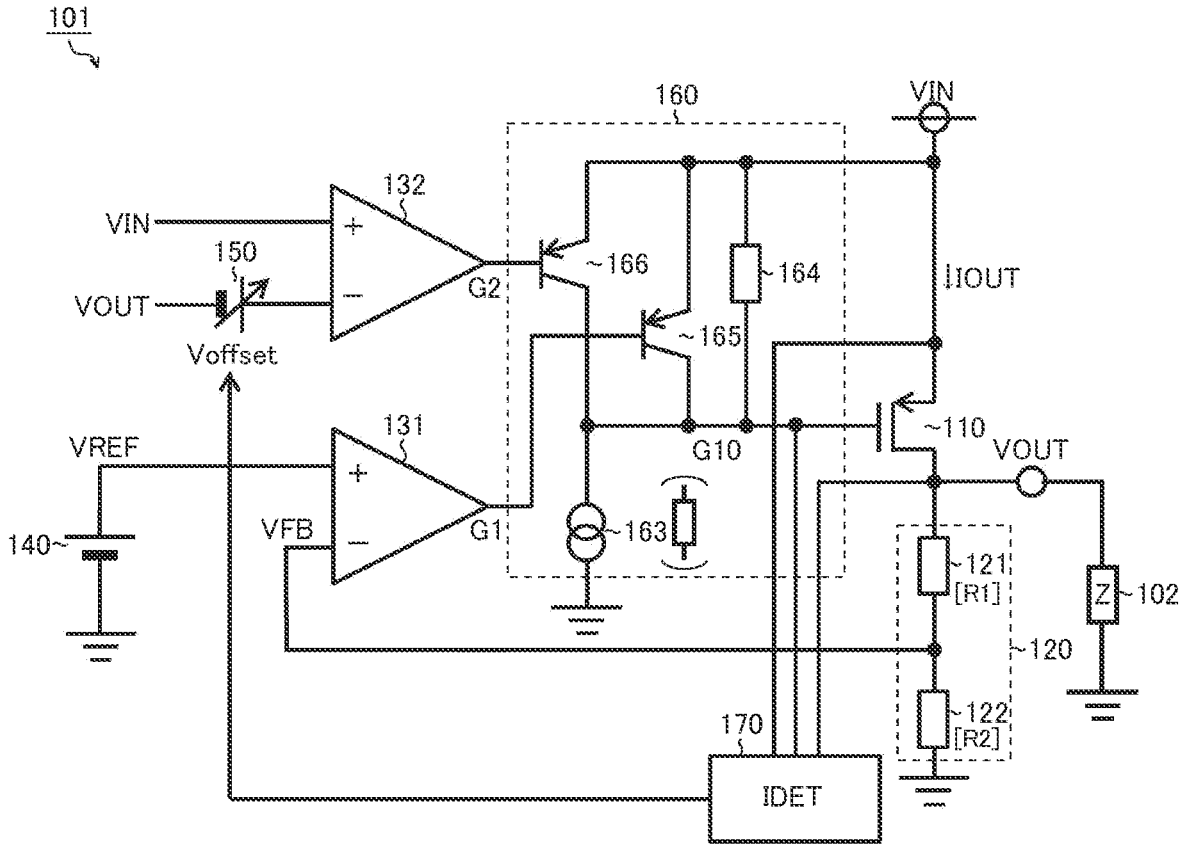
FIG. 25 is a diagram showing a linear power supply according to a twelfth embodiment.

FIG. 25 is a diagram showing a linear power supply according to a twelfth embodiment. The linear power supply 101 of this embodiment is based on the ninth embodiment (FIG. 22) described previously, and has a modification made to the configuration of the gate driver 160. More specifically, the gate driver 160 includes, instead of the PMOSFETs 161 and 162, pnp-type bipolar transistors 165 and 166.

Their interconnection is as follows. The respective emitters of the transistors 165 and 166 are connected to the input terminal for the input voltage VIN. The respective collectors of the transistors 165 and 166 are connected to the gate of the output transistor 110. The respective bases of the transistors 165 and 166 are connected to the output terminals of the amplifiers 131 and 132 respectively.

In this way, the PMOSFETs 161 and 162 may be replaced with pnp-type bipolar transistors 165 and 166. In this configuration, the gate signals G1 and G2 can be understood as base signals.

As shown in parentheses in FIG. 25, the current source 163 for generating the driving current for the gate driver 160 may be replaced with a resistor or the like.

Thirteenth Embodiment

Figure 26:
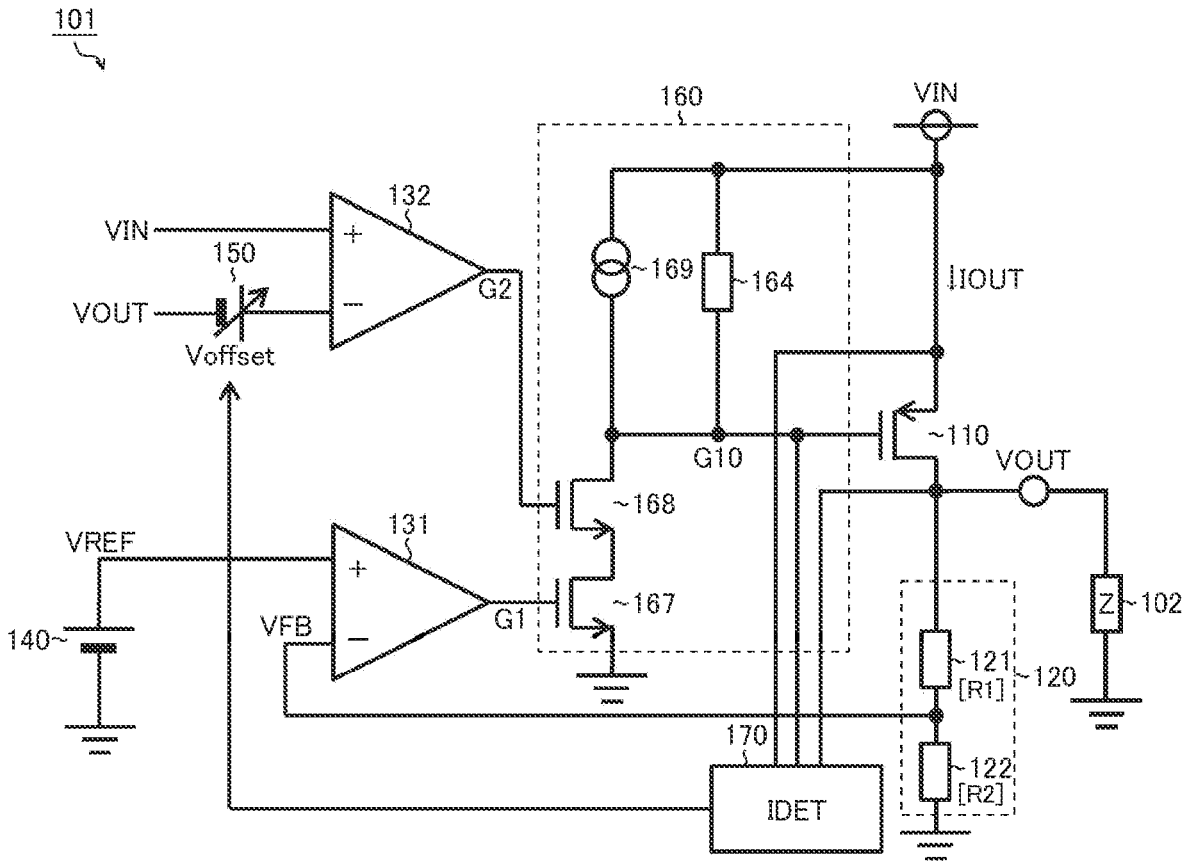
FIG. 26 is a diagram showing a linear power supply according to a thirteenth embodiment.

FIG. 26 is a diagram showing a linear power supply according to a thirteenth embodiment. The linear power supply 101 of this embodiment is based on the ninth embodiment (FIG. 22) described previously, and has a modification made to the configuration of the gate driver 160. Specifically, the gate driver 160 includes, instead of the PMOSFETs 161 and 162 and the current source 163, NMOSFETs 167 and 168 and a current source 169.

Their interconnections are as follows. The first terminal of the current source 169 is connected to the input terminal for the input voltage VIN. The second terminal of the current source 169 and the drain of the NMOSFET 168 are connected to the gate of the output transistor 110. The source of the NMOSFET 168 is connected to the drain of the NMOSFET 167. The source of the NMOSFET 167 is connected to the grounded terminal. The respective gates of the NMOSFETs 167 and 168 are connected to the output terminals of the amplifiers 131 and 132 respectively.

When the differential voltage (=VIN−VOUT) between the input voltage VIN and the output voltage VOUT is higher than the offset voltage Voffset, the NMOSFET 168 is in the fully on state, and the amplifier 131 performs ordinary output feedback control. On the other hand, when the differential voltage (=VIN−VOUT) between the input voltage VIN and the output voltage VOUT falls down to the offset voltage Voffset, the amplifier 131 is in the fully on state, and thus the amplifier 132 performs output feedback control. That is, output feedback control is applied such that the input voltage VIN and the offset output voltage (=VOUT+Voffset) are imaginarily short-circuited together.

In this way, in the gate driver 160, instead of the source current that is fed to the gate of the output transistor 110 (i.e., a current for turning off the output transistor 110), the sink current that is drawn from the gate of the output transistor 110 (i.e., a current for turning on the output transistor 110) may be controlled.

In that case, as shown in FIG. 26, the output terminals of the amplifiers 131 and 132 are logically connected in series.

In this way, depending on the polarity (P-channel or N-channel) of the output transistor 110 and the control target (source current or sink current) within the gate driver 160, the output modes (whether to logically connect their respective output terminals in series or in parallel) need to be chosen appropriately.

Fourteenth Embodiment

Figure 27:
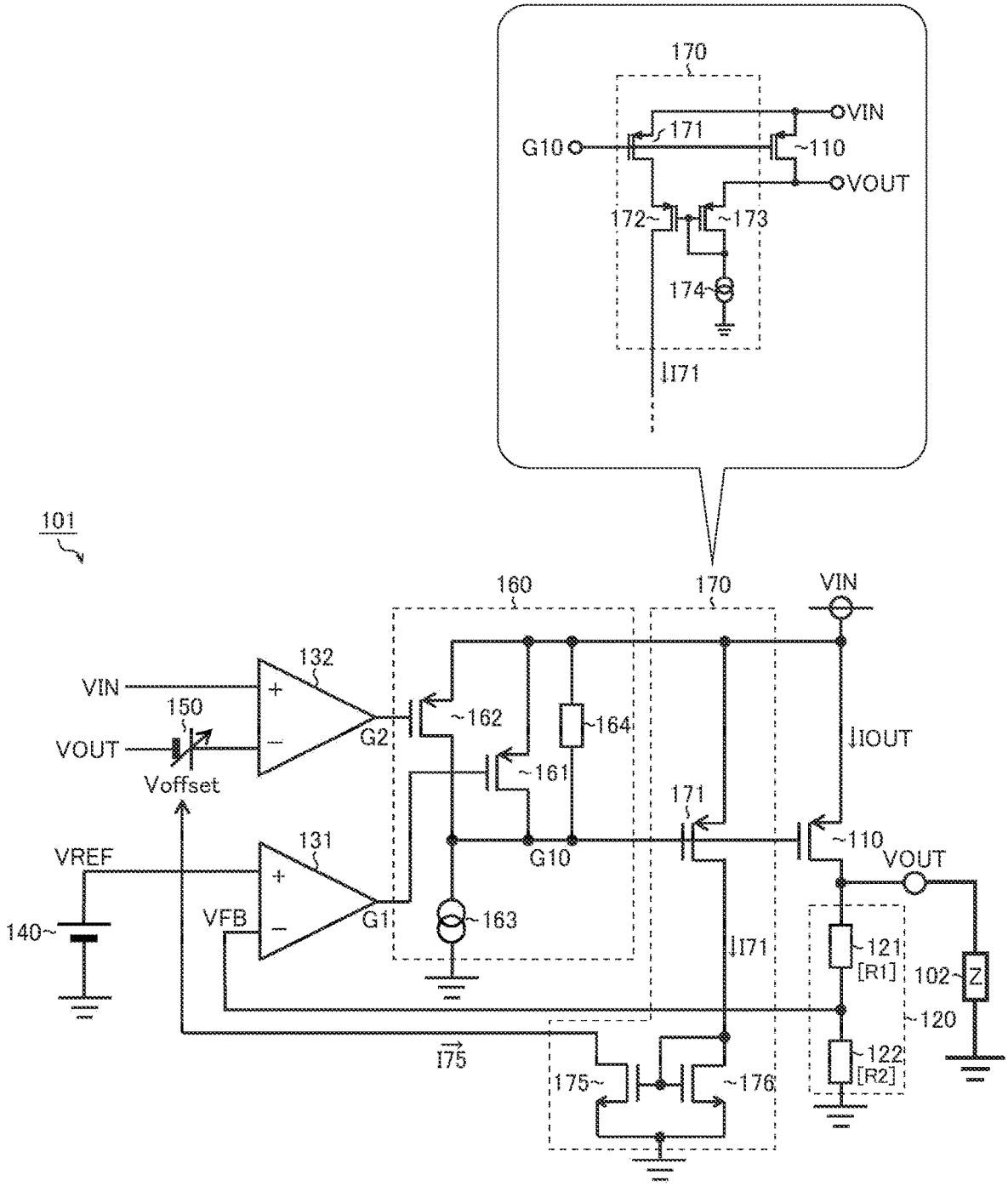
FIG. 27 is a diagram showing a linear power supply according to a fourteenth embodiment.

FIG. 27 is a diagram showing a linear power supply according to a fourteenth embodiment. The linear power supply 101 of this embodiment is based on the ninth embodiment (FIG. 22) described previously, and includes, as one specific circuit element for the current detector 170, a PMOSFET 171 (sense transistor). The source and the gate of the PMOSFET 171 are connected to the source and the gate, respectively, of the output transistor 110. Thus through the drain of the PMOSFET 171 passes a sense current I71 that is commensurate with the output current IOUT. In a case where the size ratio of the output transistor 110 to the PMOSFET 171 is m:1 (where m>1), the sense current I51 just mentioned equals 1/m of the output current IOUT.

As shown in a balloon in FIG. 27, the current detector 170 may further include PMOSFETs 172 and 173 and a current source 174 as a biasing means for keeping the drain voltage of the PMOSFET 171 equal to the drain voltage of the output transistor 110 (i.e., the output voltage VOUT).

The source of the PMOSFET 172 is connected to the drain of the PMOSFET 171. The source of the PMOSFET 173 is connected to the drain of the output transistor 110 (i.e., the application terminal for the output voltage VOUT). The respective gates of the PMOSFETs 172 and 173 are both connected to the drain of the PMOSFET 173. The drain of the PMOSFET 173 is connected to the first terminal of the current source 174. The second terminal of the current source 174 is connected to the grounded terminal.

In this way, by making equal the output node voltages (i.e., drain voltages) of the PMOSFET 171 and the output transistor 110, it is possible to make equal the drain-source voltage of the PMOSFET 171 and the drain-source voltage of the output transistor 110. It is thus possible to accurately generate a sense current I71 commensurate with the output current IOUT (hence the control signal for the offset adder 150).

While the sense current I71 may be output as the control signal for the offset adder 150, FIG. 27 shows a configuration where NMOSFETs 175 and 176 are provided as a current mirror for generating a control current I75 (=$\alpha\times$171, where $\alpha$ is the mirror ratio) commensurate with the sense current I71.

Their interconnections are as follows. The drain of the NMOSFET 176 is connected to the drain of the PMOSFET 171 (i.e., an output terminal for the sense current I71). The respective gates of the NMOSFETs 175 and 176 are connected to the drain of the NMOSFET 176. The respective sources of the NMOSFETs 175 and 176 are connected to the grounded terminal. The drain of the NMOSFET 175 is, as an output terminal for the control current I75, connected the offset adder 150.

In this way, as the control signal for the offset adder 150, a control current I75 (i.e., a mirror current) commensurate with the sense current I71 may be used.

Fifteenth Embodiment

Figure 28:
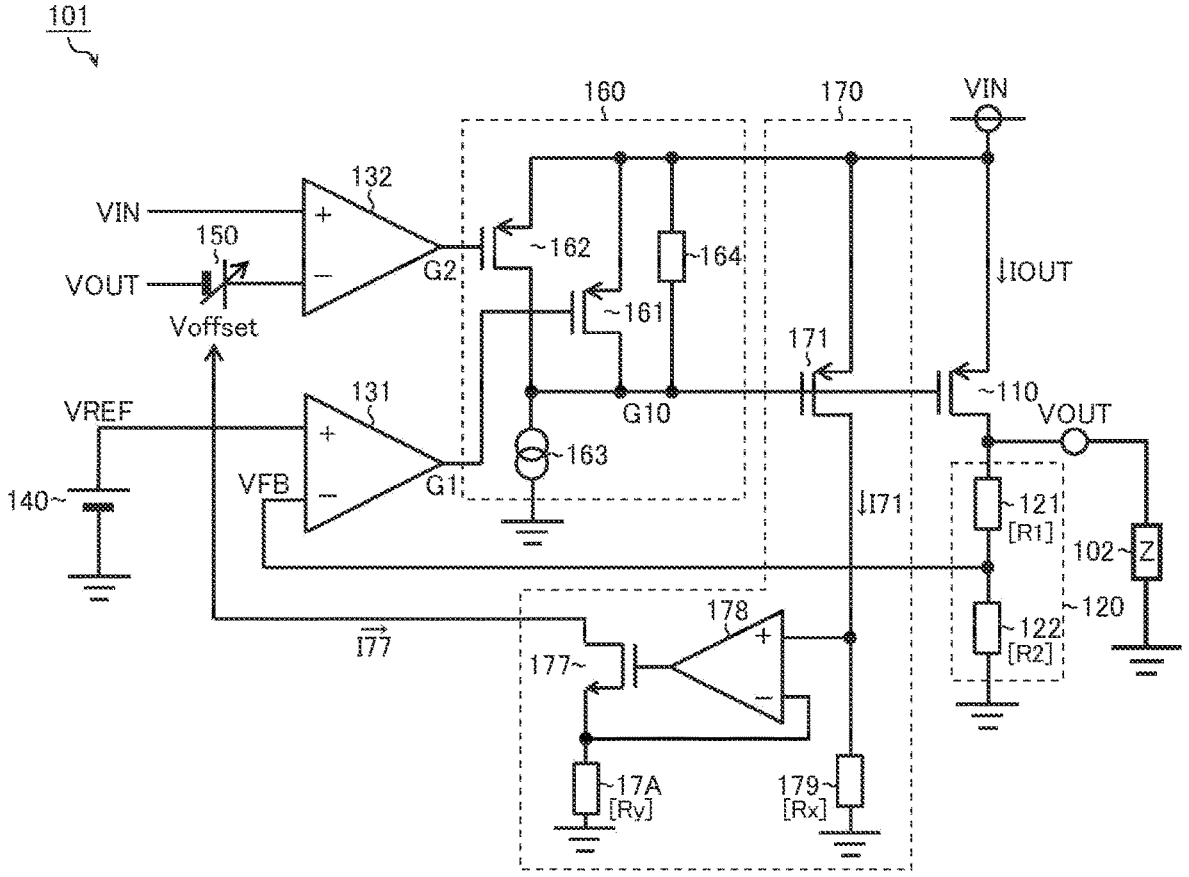
FIG. 28 is a diagram showing a linear power supply according to a fifteenth embodiment.

FIG. 28 is a diagram showing a linear power supply according to a fifteenth embodiment. The linear power supply 101 of this embodiment is based on the fourteenth embodiment (FIG. 27) described previously, and has a modification made to the configuration of the current detector 170. Specifically, the current detector 170 includes, instead of the NMOSFETs 175 and 176, an NMOSFET 177, an amplifier 178, and resistors 179 and 17A (with resistance values Rx and Ry respectively).

Their interconnections are as follows. The non-inverting input terminal (+) of the amplifier 178 and the first terminal of the resistor 179 are connected to the drain of the PMOSFET 171. The inverting input terminal (−) of the amplifier 178 and the first terminal of the resistor 17A are connected to the source of the NMOSFET 177. The respective second terminals of the resistors 179 and 17A are connected to the grounded terminal. The output terminal of the amplifier 178 is connected to the gate of the NMOSFET 177. The drain of the NMOSFET 177 is, as an output terminal for a control current I77, connected to the offset adder 150.

The amplifier 178 controls the gate of the NMOSFET 177 such that the non-inverting input terminal (+) and the inverting input terminal (−) of the amplifier 178 are imaginarily short-circuited together. Accordingly the control current I77 has a value (=(Rx/Ry)×171) in accordance with the current value of the sense current I71 and the resistance values Rx and Ry of the resistors 179 and 17A respectively.

In this way, the means for generating a control signal (control current) commensurate with the sense current I71 is not limited to a current mirror.

With the linear power supply 101 of this embodiment, by, for example, varying the resistance value of at least one of the resistors 179 and 17A, it is possible to freely adjust the variable gain for the offset voltage Voffset.

Combinations of Ninth to Fifteenth Embodiments

The ninth to fifteenth embodiments that have been described above can be implemented in any combination unless inconsistent. For example, in the twelfth, thirteenth, fourteenth, or fifteenth embodiments (FIG. 25, 26, 27, or 28 respectively), instead of the offset adder 150 an offset adder 150*a* (tenth embodiment) may be provided, or a voltage divider 120*a* (eleventh embodiment) may be added.

Overview

To follow is an overview of the various embodiments disclosed herein.

According to one aspect of what is disclosed herein, a linear power supply includes:

an output transistor configured to be connected between an input terminal for an input voltage and an output terminal for an output voltage; a driver configured to drive the output transistor such that a feedback voltage commensurate with the output voltage remains equal to a reference voltage; a current detector configured to sense an output current passing through the output transistor; and a voltage adjuster configured to adjust the reference voltage or the feedback voltage such that the differential voltage between a first voltage commensurate with the input voltage and a second voltage commensurate with the output voltage or the reference voltage does not fall below an offset voltage commensurate with the output current. (A first configuration.) The first voltage may be the input voltage itself, or a division voltage of the input voltage. The second voltage may be the output voltage itself, or a division voltage of the output voltage (i.e., the feedback voltage), or the reference voltage itself, or a division voltage of the reference voltage.

In the linear power supply of the first configuration described above, when the output current is represented by IOUT, the on-state resistance of the output transistor in the fully on state is represented by RON, and the offset voltage is represented by Voffset, the offset voltage may be variably controlled such that IOUT×RON<Voffset holds over the entire load range. (A second configuration.)

In the linear power supply of the first or second configuration described above, the offset voltage may be set at a voltage value lower than the minimum input-output voltage difference defined for the linear power supply. (A third configuration.)

In the linear power supply of any of the first to third configurations described above, the voltage adjuster may be configured to keep the reference voltage at a steady-state value when the differential voltage is higher than the offset voltage and to lower the reference voltage from the steady-state value when the differential voltage falls down to the offset voltage, thereby to prevent the differential voltage from falling further. (A fourth configuration.)

In the linear power supply of any of the first to third configurations described above, the voltage adjuster may configured to deliver the feedback voltage as it is to the driver when the differential voltage is higher than the offset voltage and to deliver the feedback voltage after raising it to the driver when the differential voltage falls down to the offset voltage, thereby to prevent the differential voltage from falling further. (A fifth configuration.)

In the linear power supply of any of the first to fifth configurations described above, the voltage adjuster may include: an offset adder configured to offset the second voltage by shifting it to the high-potential side by the offset voltage; a differential amplifier configured to be differentially fed with the first voltage and the offset second voltage; and a variable voltage source configured to adjust the reference voltage or the feedback voltage based on the output signal of the differential amplifier. (A sixth configuration.)

In the linear power supply of any of the first to fifth configurations described above, the voltage adjuster may include: an offset adder configured to offset the first voltage by shifting it to the low-potential side by the offset voltage; a differential amplifier configured to be differentially fed with the second voltage and the offset first voltage; and a variable voltage source configured to adjust the reference voltage or the feedback voltage based on the output signal of the differential amplifier. (A seventh configuration.)

In the linear power supply of the sixth or seventh configuration described above, the variable voltage source may include a transistor of which the conductivity is controlled based on the output signal of the differential amplifier, and may be configured to adjust the reference voltage or the feedback voltage in accordance with the current passing through the transistor. (An eighth configuration.)

The linear power supply of any of the first to eighth configurations described above may further include: a first resistor and a second resistor that are configured to be connected in series between an application terminal for the output voltage and a grounded terminal and that are configured to output the feedback voltage from the connection node between the first and second resistors; and a third resistor and a fourth resistor that are configured to be connected in series between an application terminal for the input voltage and the grounded terminal and that are configured to output the first voltage from the connection node between the third and fourth resistors. Here, when the resistance value of the first resistor is represented by R1, the resistance value of the second resistor is represented by R2, the resistance value of the third resistor is represented by R3, and the resistance value of the fourth resistor is represented by R4, R1:R2=R3:R4 may hold. (A ninth configuration.)

The linear power supply of the seventh configuration described above may further include: a first resistor and a second resistor that are configured to be connected in series between an application terminal for the output voltage and a grounded terminal and that are configured to output the feedback voltage from the connection node between the first and second resistors; a third resistor and a fourth resistor that are configured to be connected in series between an application terminal for the input voltage and the grounded terminal and that are configured to output the first voltage from the connection node between the third and fourth resistors; and a fifth resistor connected between the application terminal for the input voltage and the first resistor. Here, when the resistance value of the first resistor is represented by R1, the resistance value of the second resistor is represented by R2, the resistance value of the third resistor is represented by R3, and the resistance value of the fourth resistor is represented by R4, R1:R2=R3:R4 may holds. Moreover, the current detector may be configured to draw a current commensurate with the output current from an output terminal for the first voltage toward the grounded terminal. (A tenth configuration.)

According to one aspect of what is disclosed herein, a linear power supply includes: an output transistor configured to be connected between an input terminal for an input voltage and an output terminal for an output voltage; a first amplifier configured to generate a first driving signal by amplifying the difference between the output voltage or a voltage commensurate with it and a predetermined reference voltage; a second amplifier configured to generate a second driving signal by amplifying the difference between the input voltage or a voltage commensurate with it and the output voltage or a voltage commensurate with it; a driver configured to drive the output transistor in accordance with the first and second driving signal; a current detector configured to generate a control signal by sensing an output current passing through the output transistor; and an offset adder configured to feed the second amplifier with an offset voltage commensurate with the control signal. (An eleventh configuration.)

In the linear power supply of the eleventh configuration described above, when the output current is represented by IOUT, the on-state resistance of the output transistor in the fully on state is represented by RON, and the offset voltage is represented by Voffset, the offset voltage may be variably controlled such that IOUT×RON<Voffset holds over the entire load range. (A twelfth configuration.)

In the linear power supply of the eleventh or twelfth configuration described above, the offset voltage may be set at a voltage value lower than the minimum input-output voltage difference defined for the linear power supply. (A thirteenth configuration.)

In the linear power supply of any of the eleventh to thirteenth configurations described above, the offset adder may configured to feed the output voltage or a voltage commensurate with it, after shifting it, to the high-potential side by the offset voltage, to the second amplifier. (A fourteenth configuration.)

In the linear power supply of any of the eleventh to thirteenth configurations described above, the offset adder maybe configured to feed the input voltage or a voltage commensurate with it, after shifting it, to the low-potential side by the offset voltage, to the second amplifier. (A fifteenth configuration.)

The linear power supply of any of the eleventh to fifteenth configurations described above may further include: a first resistor and a second resistor that are configured to be connected in series between the output terminal for the output voltage and a grounded terminal and that are configured to output a divided output voltage from the connection node between the first and second resistors to the second amplifier; and a third resistor and a fourth resistor that are configured to be connected in series between the input terminal for the input voltage and the grounded terminal and that are configured to output a divided output voltage from the connection node between the third and fourth resistors to the second amplifier. Here, when the resistance values of the first to fourth resistors are represented by R1, R2, R3, and R4 respectively, R1:R2=R3:R4 may hold. (A sixteenth configuration.)

In the linear power supply of any of the eleventh to sixteenth configurations described above, the driver may include a first transistor and a second transistor that are connected in parallel between the input terminal for the input voltage and the control terminal of the output transistor and that are controlled by the first and second driving signal respectively. (A seventeenth configuration.)

In the linear power supply of any of the eleventh to sixteenth configurations described above, the driver may include a first transistor and a second transistor that are connected in parallel between the control terminal of the output transistor and a grounded terminal and that are controlled by the first and second driving signal respectively. (A eighteenth configuration.)

In the linear power supply of any of the eleventh to eighteenth configurations described above, the current detector may include a sense transistor configured to generate a sense current commensurate with the output current, and may be configured to feed, as the control signal, the sense current or a current signal commensurate with it to the offset adder. (A nineteenth configuration.)

In the linear power supply of the nineteenth configuration described above, the current detector may further include a biasing means for making equal the output node voltages of the sense transistor and the output terminal. (A twentieth configuration.)

Application to Vehicles

Figure 29:
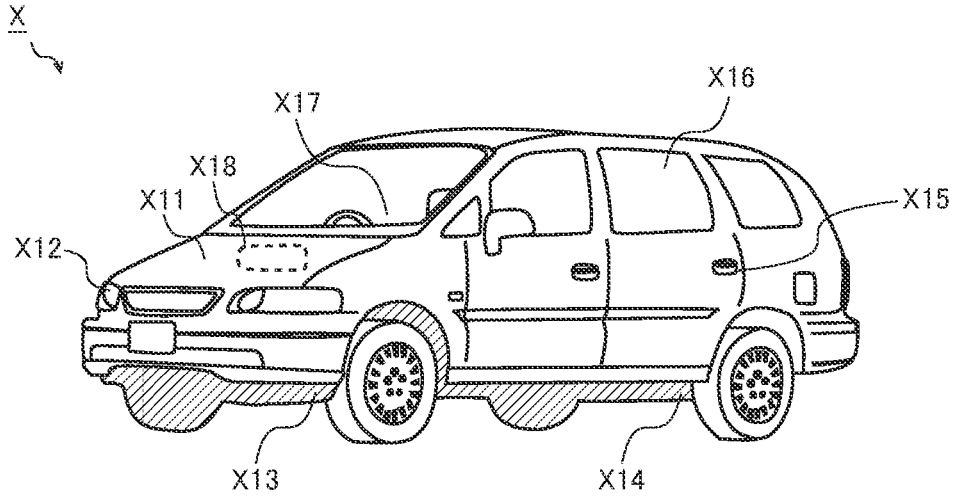
FIG. 29 is an exterior view of a vehicle.

FIG. 29 is an exterior view of a vehicle X. The vehicle X of this configuration example incorporates various electronic appliances X11 to X18 that operate by being fed with a voltage supplied from a battery (not shown). For the sake of convenience, FIG. 29 may not show the electronic appliances X11 to X18 at the places where they are actually arranged.

The electronic appliance X11 is an engine control unit which performs control with respect to an engine (injection control, electronic throttle control, idling control, oxygen sensor heater control, automatic cruise control, etc.).

The electronic appliance X12 is a lamp control unit which controls the lighting and extinguishing of HIDs (high-intensity discharged lamps) and DRLs (daytime running lamps).

The electronic appliance X13 is a transmission control unit which performs control with respect to a transmission.

The electronic appliance X14 is a behavior control unit which performs control with respect to the movement of the vehicle X (ABS [anti-lock brake system] control, EPS (electric power steering) control, electronic suspension control, etc.).

The electronic appliance X15 is a security control unit which drives and controls door locks, burglar alarms, and the like.

The electronic appliance X16 comprises electronic appliances incorporated in the vehicle X as standard or manufacturer-fitted equipment at the stage of factory shipment, such as wipers, power side mirrors, power windows, dampers (shock absorbers), a power sun roof, and power seats.

The electronic appliance X17 comprises electronic appliances fitted to the vehicle X optionally as user-fitted equipment, such as A/V [audio/visual] equipment, a car navigation system, and an ETC [electronic toll control system].

The electronic appliance X18 comprises electronic appliances provided with high-withstand-voltage motors, such as a vehicle-mounted blower, an oil pump, a water pump, and a battery cooling fan.

Any of the linear power supply circuits 1 and 101 described previously can be incorporated in any of the electronic appliances X11 to X18.

Other Modifications

The various technical features disclosed herein may be implemented in any other manners than in the embodiments described above, and allow for any modifications made within the spirit of their technical ingenuity. That is, the embodiments described above should be considered to be in every aspect illustrative and not restrictive, and the technical scope of the present invention should be understood to be defined not by the description of the embodiments described above but by the appended claims and to encompass any modifications made in a sense and scope equivalent to the claims.

INDUSTRIAL APPLICABILITY

The invention disclosed herein finds applications in vehicle-related appliances, marine vessel-related appliances, office appliances, portable appliances, smartphones, and the like.

REFERENCE SIGNS LIST

1 linear power supply
2 load
10 output transistor (PMOSFET)
20, 20*a* voltage divider
21, 22, 23, 24, 25 resistor
30 driver
40 reference voltage adjuster
41, 41*a* offset adder
42 differential amplifier
43 variable voltage source
43*a* NMOSFET
43*b*, 43*c* resistor
43*d* PMOSFET
50 current detector
51 PMOSFET
52, 53 PMOSFET
54 current source
55, 56 NMOSFET
60 constant voltage source
70 feedback voltage adjuster
71 71*a* offset adder

72 differential amplifier
73 variable voltage source
73*a* PMOSFET
101 linear power supply
102 load
110 output transistor (PMOSFET)
120, 120*a* voltage divider
121, 122, 123, 124 resistor
130, 131, 132 amplifier
140 reference voltage generator
150, 150*a* offset adder
160 gate driver
161, 162 PMOSFET
163 current source
164 resistor
165, 166 pnp-type bipolar transistor
167, 168 NMOSFET
169 current source
170 current detector
171, 172, 173 PMOSFET
174 current source
175, 176, 177 NMOSFET
178 amplifier
179, 17A resistor
X vehicle
X11-X18 electronic appliance

The invention claimed is:

1. A linear power supply, comprising:
an output transistor configured to be connected between an input terminal for an input voltage and an output terminal for an output voltage;
a driver configured to drive the output transistor such that a feedback voltage commensurate with the output voltage remains equal to a reference voltage;
a current detector configured to sense an output current passing through the output transistor; and
a voltage adjuster configured to adjust the reference voltage or the feedback voltage such that a differential voltage between a first voltage commensurate with the input voltage and a second voltage commensurate with the output voltage or the reference voltage does not fall below an offset voltage commensurate with the output current.

2. The linear power supply according to claim 1, wherein when
the output current is represented by IOUT,
an on-state resistance of the output transistor in a fully on state is represented by RON, and
the offset voltage is represented by Voffset,
the offset voltage is variably controlled such that IOUT×RON<Voffset holds over an entire load range.

3. The linear power supply according to claim 1, wherein the offset voltage is set at a voltage value lower than a minimum input-output voltage difference defined for the linear power supply.

4. The linear power supply according to claim 1, wherein the voltage adjuster is configured
to keep the reference voltage at a steady-state value when the differential voltage is higher than the offset voltage and
to lower the reference voltage from the steady-state value when the differential voltage falls down to the offset voltage, thereby to prevent the differential voltage from falling further.

5. The linear power supply according to claim 1, wherein the voltage adjuster is configured
to deliver the feedback voltage as it is to the driver when the differential voltage is higher than the offset voltage and
to deliver the feedback voltage after raising it to the driver when the differential voltage falls down to the offset voltage, thereby to prevent the differential voltage from falling further.

6. The linear power supply according to claim 1, wherein the voltage adjuster includes:
an offset adder configured to offset the second voltage by shifting it to a high-potential side by the offset voltage;
a differential amplifier configured to be differentially fed with the first voltage and the offset second voltage; and
a variable voltage source configured to adjust the reference voltage or the feedback voltage based on an output signal of the differential amplifier.

7. The linear power supply according to claim 6, wherein the variable voltage source
includes a transistor of which conductivity is controlled based on the output signal of the differential amplifier, and
is configured to adjust the reference voltage or the feedback voltage in accordance with a current passing through the transistor.

8. The linear power supply according to claim 1, wherein the voltage adjuster includes:
an offset adder configured to offset the first voltage by shifting it to a low-potential side by the offset voltage;
a differential amplifier configured to be differentially fed with the second voltage and the offset first voltage; and
a variable voltage source configured to adjust the reference voltage or the feedback voltage based on an output signal of the differential amplifier.

9. The linear power supply according to claim 8, further comprising:
a first resistor and a second resistor
configured to be connected in series between an application terminal for the output voltage and a grounded terminal and
configured to output the feedback voltage from a connection node between the first and second resistors;
a third resistor and a fourth resistor
configured to be connected in series between an application terminal for the input voltage and the grounded terminal and
configured to output the first voltage from a connection node between the third and fourth resistors; and
a fifth resistor connected between the application terminal for the input voltage and the first resistor,
wherein
when
a resistance value of the first resistor is represented by R1,
a resistance value of the second resistor is represented by R2,
a resistance value of the third resistor is represented by R3, and
a resistance value of the fourth resistor is represented by R4,
R1: R2=R3: R4 holds, and
the current detector is configured to draw a current commensurate with the output current from an output terminal for the first voltage toward the grounded terminal.

10. The linear power supply according to claim 1, further comprising:
a first resistor and a second resistor configured to be connected in series between an application terminal for the output voltage and a grounded terminal and configured to output the feedback voltage from a connection node between the first and second resistors; and a third resistor and a fourth resistor configured to be connected in series between an application terminal for the input voltage and the grounded terminal and configured to output the first voltage from a connection node between the third and fourth resistors, wherein when a resistance value of the first resistor is represented by R1, a resistance value of the second resistor is represented by R2, a resistance value of the third resistor is represented by R3, and a resistance value of the fourth resistor is represented by R4, R1: R2=R3: R4 holds.

11. A linear power supply, comprising:

an output transistor configured to be connected between an input terminal for an input voltage and an output terminal for an output voltage;

a first amplifier configured to generate a first driving signal by amplifying a difference between the output voltage or a voltage commensurate therewith and a predetermined reference voltage;

a second amplifier configured to generate a second driving signal by amplifying a difference between the input voltage or a voltage commensurate therewith and the output voltage or a voltage commensurate therewith;

a driver configured to drive the output transistor in accordance with the first and second driving signal;

a current detector configured to generate a control signal by sensing an output current passing through the output transistor; and an offset adder configured to feed the second amplifier with an offset voltage commensurate with the control signal.

12. The linear power supply according to claim 11, wherein when the output current is represented by IOUT, an on-state resistance of the output transistor in a fully on state is represented by RON, and the offset voltage is represented by Voffset, the offset voltage is variably controlled such that IOUT×RON<Voffset holds over an entire load range.

13. The linear power supply according to claim 11, wherein the offset voltage is set at a voltage value lower than a minimum input-output voltage difference defined for the linear power supply.

14. The linear power supply according to claim 11, wherein the offset adder is configured to feed the output voltage or a voltage commensurate therewith, after shifting it, to a high-potential side by the offset voltage, to the second amplifier.

15. The linear power supply according to claim 11, wherein the offset adder is configured to feed the input voltage or a voltage commensurate therewith, after shifting it, to a low-potential side by the offset voltage, to the second amplifier.

16. The linear power supply according to claim 11, further comprising:

a first resistor and a second resistor configured to be connected in series between the output terminal for the output voltage and a grounded terminal and configured to output a divided output voltage from a connection node between the first and second resistors to the second amplifier; and a third resistor and a fourth resistor configured to be connected in series between the input terminal for the input voltage and the grounded terminal and configured to output a divided output voltage from a connection node between the third and fourth resistors to the second amplifier;

wherein when resistance values of the first to fourth resistors are represented by R1, R2, R3, and R4 respectively, R1: R2=R3: R4 holds.

17. The linear power supply according to claim 11, wherein the driver includes a first transistor and a second transistor connected in parallel between the input terminal for the input voltage and a control terminal of the output transistor, the first and second transistors being controlled by the first and second driving signal respectively.

18. The linear power supply according claim 11, wherein the driver includes a first transistor and a second transistor connected in parallel between a control terminal of the output transistor and a grounded terminal, the first and second transistors being controlled by the first and second driving signal respectively.

19. The linear power supply according to claim 11, wherein the current detector includes a sense transistor configured to generate a sense current commensurate with the output current, the current detector being configured to feed, as the control signal, the sense current or a current signal commensurate therewith to the offset adder.

20. The linear power supply according to claim 19, wherein the current detector further includes a biasing means for making equal output node voltages of the sense transistor and the output terminal.

* * * * *